US006918641B2

(12) United States Patent
Martinez, Jr.

(10) Patent No.: US 6,918,641 B2
(45) Date of Patent: Jul. 19, 2005

(54) METHODS AND APPARATUS FOR IMAGE TRANSFER

(76) Inventor: Raul Martinez, Jr., 4128 Via Candidiz, No. 150, San Diego, CA (US) 92130

( * ) Notice: Subject to any disclaimer, the term of this patent is extended or adjusted under 35 U.S.C. 154(b) by 129 days.

(21) Appl. No.: 10/623,299

(22) Filed: Jul. 17, 2003

(65) Prior Publication Data

US 2004/0017407 A1 Jan. 29, 2004

Related U.S. Application Data

(63) Continuation-in-part of application No. 09/877,828, filed on Jun. 8, 2001, now Pat. No. 6,746,093.

(51) Int. Cl.[7] ..... B41J 3/00

(52) U.S. Cl. ..... 347/2; 82/152; 141/1; 409/165

(58) Field of Search ..... 347/1, 2, 4, 104, 347/105; 82/117, 118, 152; 101/35, 36, 38.1; 141/1; 142/1; 409/165; 346/139 R, 139 C, 141

(56) References Cited

U.S. PATENT DOCUMENTS 3,484,342 A * 12/1969 Fuerst et al. ..... 205/202
4,201,821 A * 5/1980 Fromson et al. ..... 428/203
4,459,601 A * 7/1984 Howkins ..... 347/68
4,523,200 A * 6/1985 Howkins ..... 347/11
4,580,147 A * 4/1986 DeYoung et al. ..... 347/88
4,592,292 A * 6/1986 Olsson et al. ..... 110/347
4,593,292 A * 6/1986 Lewis ..... 347/88
4,646,102 A * 2/1987 Akaeda et al. ..... 343/915
4,741,288 A * 5/1988 Anderson et al. ..... 119/831
5,831,641 A * 11/1998 Carlson ..... 347/2
6,746,093 B2 * 6/2004 Martinez ..... 347/2

* cited by examiner

*Primary Examiner*—Juanita D. Stephens

(57) ABSTRACT

A method and apparatus for imprinting high quality images on non-planar surfaces, including the surfaces of various types of three-dimensional articles, such as baseball bats, formed from a number of different types of materials. In the preferred method of the invention, the non-planar surfaces of the three-dimensional articles are printed using a uniquely modified ink jet image transfer technique. The apparatus of the invention includes a ink jet printer coupled with a novel article positioning apparatus which functions to support a plurality of circumferentially spaced apart articles, to move a selected one of the circumferentially spaced articles into proximity with the ink jet printer and to controllably rotate the selected one of the circumferentially spaced articles.

14 Claims, 22 Drawing Sheets

12

44
44a
54
46
54a
56
65
48
50
52a
52
54
67
12

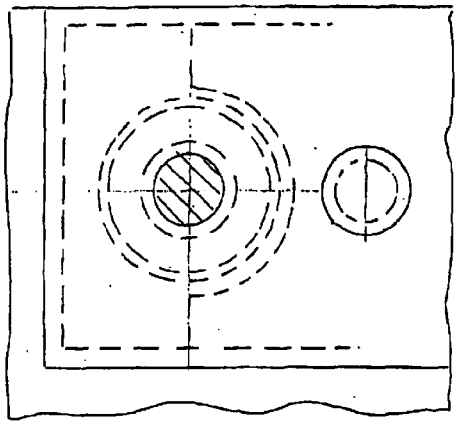
FIG. 26
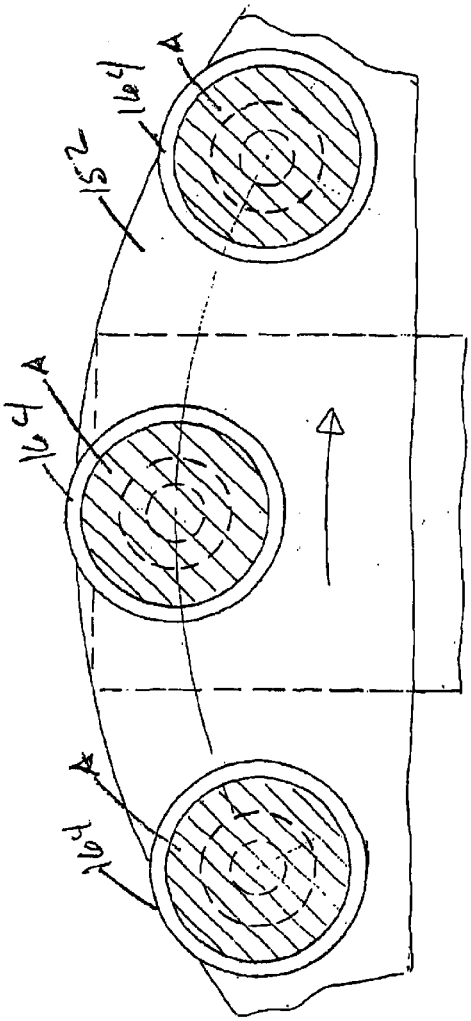
FIG. 20
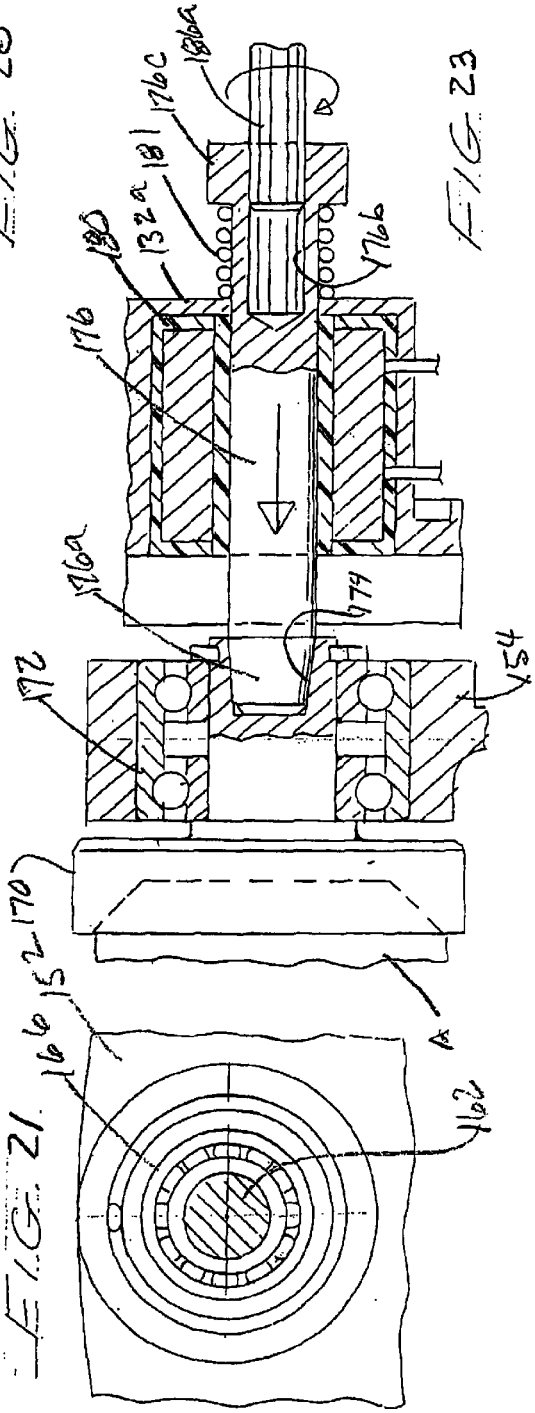
FIG. 21
FIG. 23

128

128
170
170
170
A
A
A
-154-

172
168
172
168
172
168
-154-

METHODS AND APPARATUS FOR IMAGE TRANSFER

SPECIFICATION

This is a Continuation-In-Part Application of U.S. application Ser. No. 09/877,828 filed on Jun. 8, 2001 now U.S. Pat. No. 6,746,093.

BACKGROUND OF THE INVENTION

1. Field of the Invention

The present invention relates generally to methods and apparatus for imprinting images on the surfaces of three-dimensional objects. More particularly, the invention concerns a novel, improved method and apparatus for non-contact, high-quality, distortion-free printing of images on non-planar surfaces of three-dimensional objects using ink jet printing technology.

2. Discussion of the Prior Art

Various types of image transfer techniques have been suggested in the past for imprinting images on a number of different material surfaces including cloth, wood, metal and ceramics. A very common technique, which has been widely used, is silk screening. However, such a technique is generally limited to printing on smooth, flat surfaces. Further, such technique produces a relatively low quality prints when compared to that produced by lithography, gravure, letterpress sublimation and laser printing.

When the image is to be transferred to a metal surface, prior art sublimation techniques are frequently used. For example, Blake et al, U.S. Pat. No. 3,484,342 issued Dec. 16, 1969 and Fromson et al, U.S. Pat. No. 4,201,821 issued May 6, 1980 both suggest decorating unsealed and coated anodized aluminum using sublimation techniques. However, Sublimation processes also have substantial drawbacks, particularly when the surface of the object, which is printed, is non-planar. Transferring an image or graphic to a sphere or curved, cylindrically tapered surface by means of sublimation, is extremely difficult and such an approach, if achievable at all, would typically result in a poor quality, highly distorted image.

When printing on non-planar surfaces is required, several techniques have been suggested. For example, U.S. Pat. No. 4,741,288 issued to Stirbis et al discloses an apparatus for decorating a cylindrical can. The Stirbis et al apparatus makes use of a multiple station ink supply and a transfer apparatus for transferring ink from an ink fountain to a rotatable inking blanket wheel through a plate cylinder. The apparatus includes an ink image registration adjustment apparatus and an axial and circumferential tightness control apparatus operatively associated with each plate cylinder and each ink supply and transfer apparatus. In addition to techniques involving the use of rotatable inking wheels such as described in Stirbis et al, other techniques, which have been suggested for imprinting images on non-planar surfaces, include electrophotographic imaging and magnetic imaging. As a general rule, these techniques have met with limited commercial success.

U.S. Pat. No. 5,831,641 issued to Carlson discloses a method and apparatus for imprinting images on non-planar surfaces, including the surfaces of various types of three-dimensional articles, such as baseball bats. The apparatus includes a modified ink jet plotter coupled with an article positioning apparatus which functions to automatically maintain the surface of the article to be printed within a plane substantially parallel to and slightly spaced apart from the place within which the ink jet nozzles of the ink jet plotter reside.

Another prior art technique, which is frequently used to decorate surfaces, such as anodized aluminum surfaces, involves the use of transfer films. These films typically overlay the metal surface and undesirably, are subject to film deterioration and unattractive abrasion. A very popular prior art printing technique, which has found wide acceptance in recent years, is ink jet printing. Within perhaps the last five years this technology has become the dominant technology for printing color images and graphics in the office and home markets. Ink jet printing basically involves a process whereby ink particles are projected in a continuous stream toward the surface to be imprinted using appropriate computer control to create text and graphics on the printing substrate. A number of different types of ink jet printers/plotters are readily commercially available from sources such as Calcomp, Packard Bell, NEC Technologies and Mutoh America, Inc.

As will be better understood from the discussion which follows, the method and apparatus of the present invention overcomes most of the problems encountered in prior art attempts to print detailed images on non-planar surfaces by employing a uniquely modified prior art ink jet image transfer technique.

SUMMARY OF THE INVENTION

It is an object of the present invention to provide a method and apparatus for imprinting high quality images on non-planar surfaces, including the surfaces of various types of three-dimensional articles formed from a number of different types of materials.

Another object of the invention is to provide a method and apparatus of the aforementioned character in which the non-planar surfaces are printed using a uniquely modified ink jet image transfer technique.

Another object of the invention is to provide a method as described in the preceding paragraphs in which the image is printed on the surface of the article using a plurality of ink jet cartridges, the nozzles of which never touch the surface of the article, which is being printed.

Another object of the invention is to provide an apparatus of the character described in the immediately preceding paragraph which includes a novel article positioning apparatus which functions to controllably rotate the article to be printed and to automatically maintain the longitudinal axis of the article within a plane substantially parallel to and spaced apart from the plane within which the ink jet nozzles reside.

Another object of the invention is to provide an apparatus of the class described which includes a novel article positioning apparatus which supports a plurality of articles and functions to sequentially bring each of the articles into position proximate the printing heads of the apparatus and then to controllably rotate the article while maintaining the longitudinal axis of the article within a plane substantially parallel to and spaced apart from the plane within which the ink jet nozzles reside.

A specific object of the invention is to provide a method and apparatus for imprinting detailed color images on the tapered cylindrical surface such as that found on the barrel and intermediate surfaces of a baseball bat.

Another object of the invention is to provide an apparatus of the class described in which the article positioning portion of the apparatus is operably coupled with a conventional type of commercially available ink jet plotter.

Another object of the invention is to provide an apparatus for imprinting high quality images on non-planar surfaces that is simple to use, is reliable in operation and requires minimum maintenance.

By way of brief summary, a major advantage of the method and apparatus of the present invention is the ability to produce high-quality, multi-colored prints on non-planar surfaces of the character not readily adapted to pass through printing machinery, including surfaces found on a number of differently configured, three-dimensional articles such as baseball bats and the like. In this regard, a particular advantage of the apparatus of the present invention is its ability to print high quality images on curved wood and metal surfaces without the dispensing nozzles of the ink jet cartridges of the apparatus coming into physical contact with the surface to be printed.

In one embodiment of the invention, the article holding and positioning apparatus of the invention is coupled with a conventional, mircoprocessor based digital plotter of the character having a plurality of ink jet cartridges which travel longitudinally of the print zone of the plotter. Typically, three ink jet cartridges contain ink of the three primary colors, namely red, yellow and blue. While a fourth cartridge contains black ink. This allows the computer program developed and stored in the computer memory to cause the application of a multiplicity of individual ink dots of various colors to the work surface so that, when combined by the human eye, appear as photo quality images. In operation of the apparatus of the invention, the article to be imprinted is typically rotated relative to the ink jet cartridges and the surface to be imprinted with the longitudinal axis of the article continuously maintained in a plane which is parallel to and spaced apart from the plane within which the ink jet nozzles reside.

In one form of the method of the invention a computer is used to communicate to the printing apparatus information containing the predetermined pattern to be printed which has either been previously scanned or originally generated using specialized software. The pattern information is typically stored in the computer memory and then sent via cable to the printing apparatus which preferably comprises a conventional printer having four color ink jet print heads capable of dispensing pigmented inks or dyes comprised of either a solvent or water base material. A printed circuit board operably associated with the cable controllably fires the nozzles of the print heads to spray microdots of ink onto the surface to be printed in the predetermined pattern.

According to one embodiment of the invention, the microdots have a diameter of approximately 0.0500-mm (0.002 inches) thereby enabling intricate images to be imprinted on the surface. Upon contact with the surface, the ink solidifies and leaves a digitally generated or scanned image or graphic on the surface without the ink jet nozzles ever coming into physical contact with the surface.

Images to be applied to irregular, non-linear surfaces as occur with changing diameters that are rotating at a constant angular rate can be printed to result in linear appearance by computer programming. The subject apparatus can also achieve the linear appearance by producing graphics that compensate dimensionally for the changing diameters and then, by scanning the graphic artwork, computer data can be recorded and stored for use on the subject equipment when desired.

Computer stored images can be edited on the computer monitor screen to eliminate images, add images or erase spaces for insertion of images. Such images can be nomenclature; video camera generated photo quality images (people, objects, animals, etc.). Changes can be accomplished expeditiously just prior to printing.

Using the techniques described in the preceding paragraphs, high quality images can quickly and easily be imprinted on a variety of different types of materials and upon the non-planar surfaces of a number of types of irregularly configured three-dimensional articles.

BRIEF DESCRIPTION OF THE INVENTION

Figure 1:
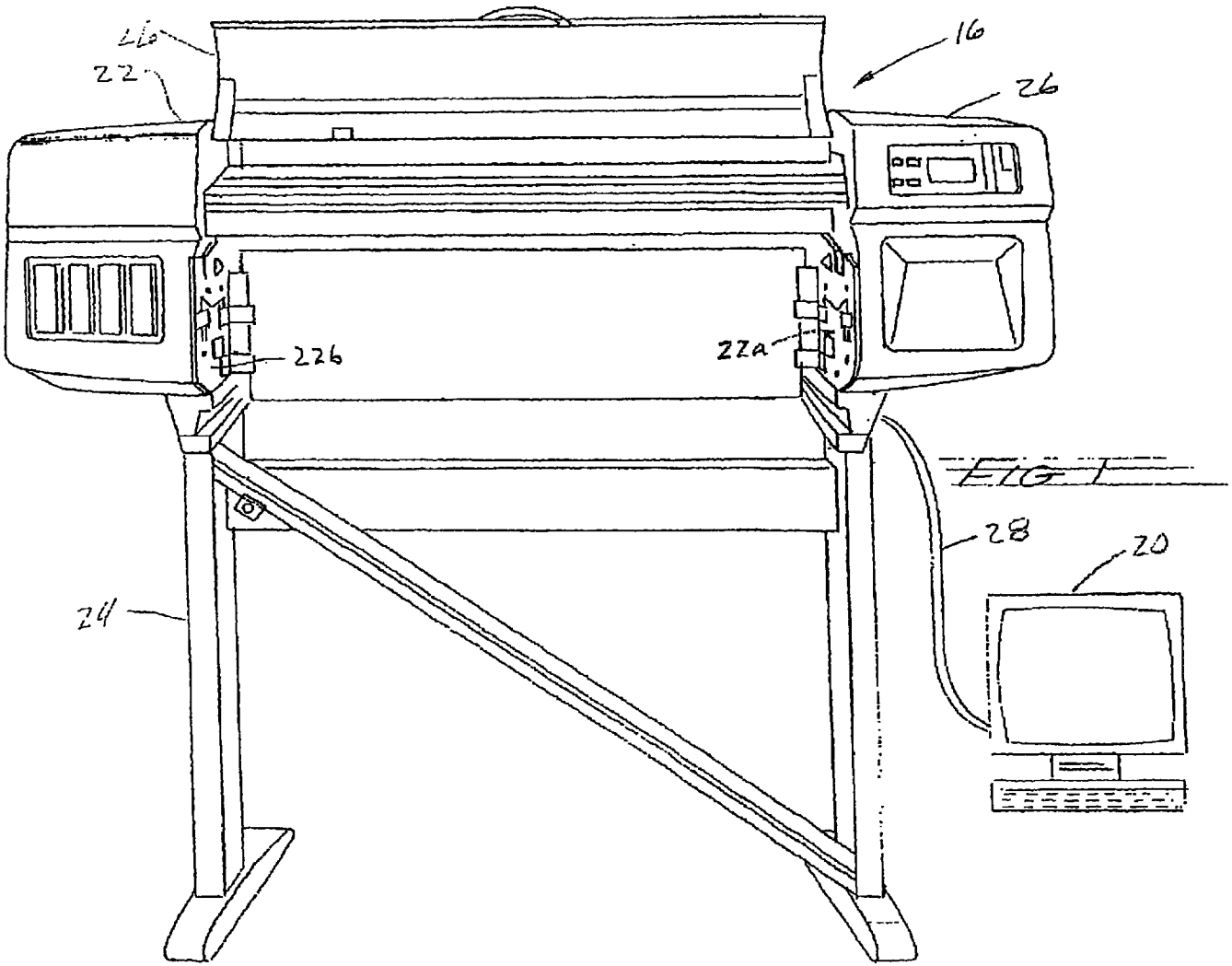
FIG. 1 is a generally perspective view of one form of a modified, commercially available plotter that forms a part of the apparatus of the invention for imprinting a predetermined pattern on a surface of a three-dimensional article such as a baseball bats.
Figure 3:
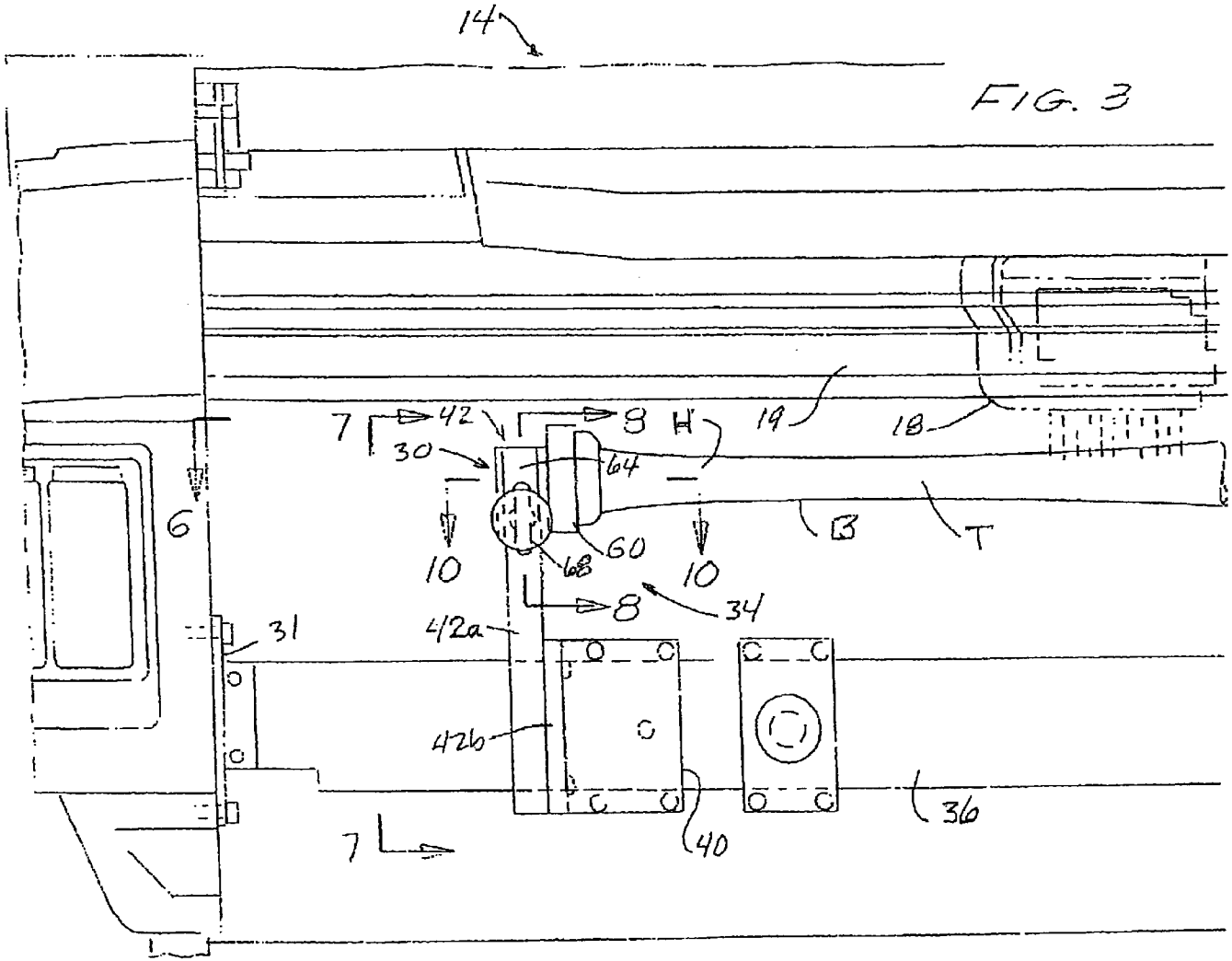
Figure 3A:
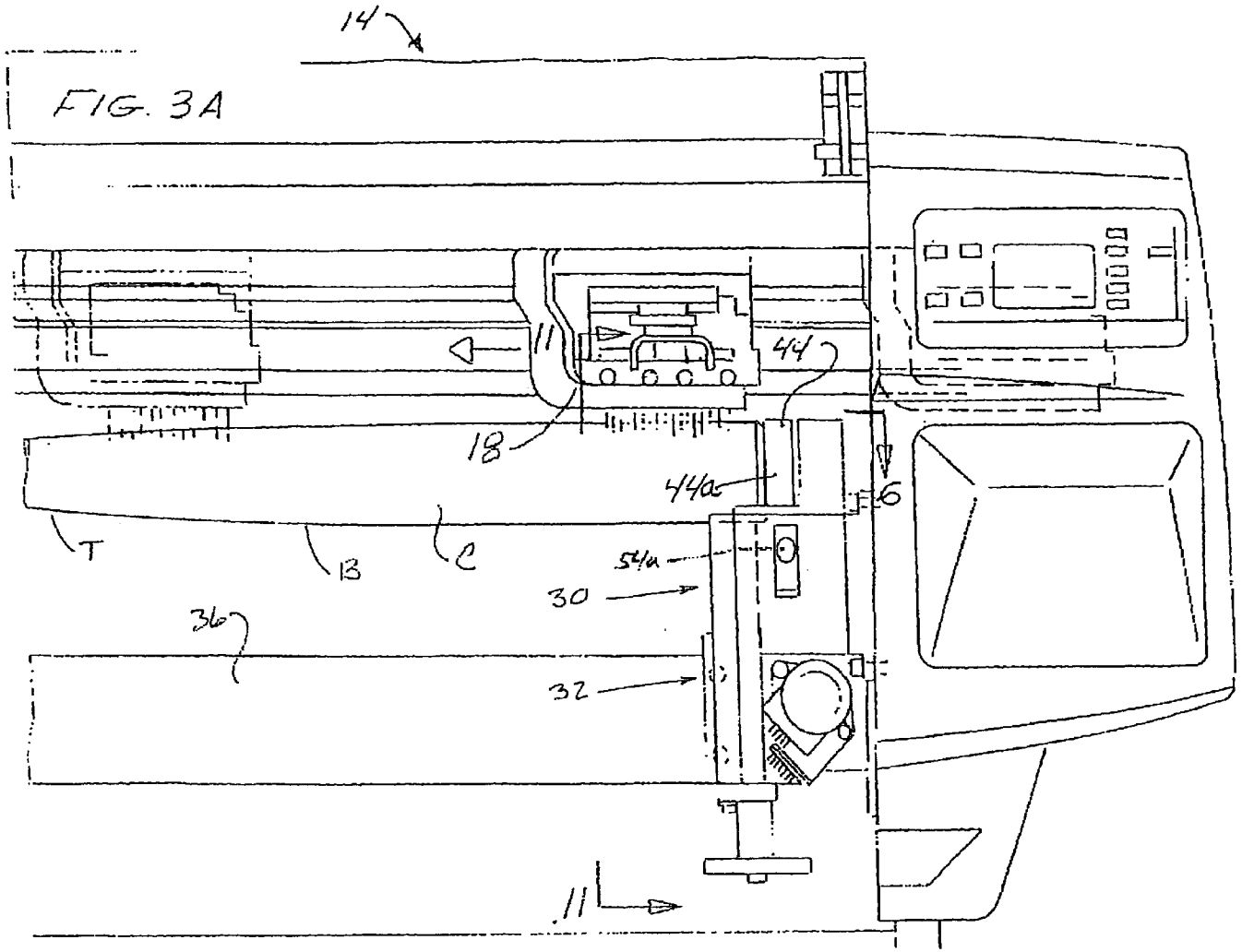

FIGS. 3 and 3A in combination comprise a front view of the apparatus of the invention shown in FIG. 1 following the connection to the apparatus of the novel three-dimensional article positioning subassembly the apparatus.

Figure 4:
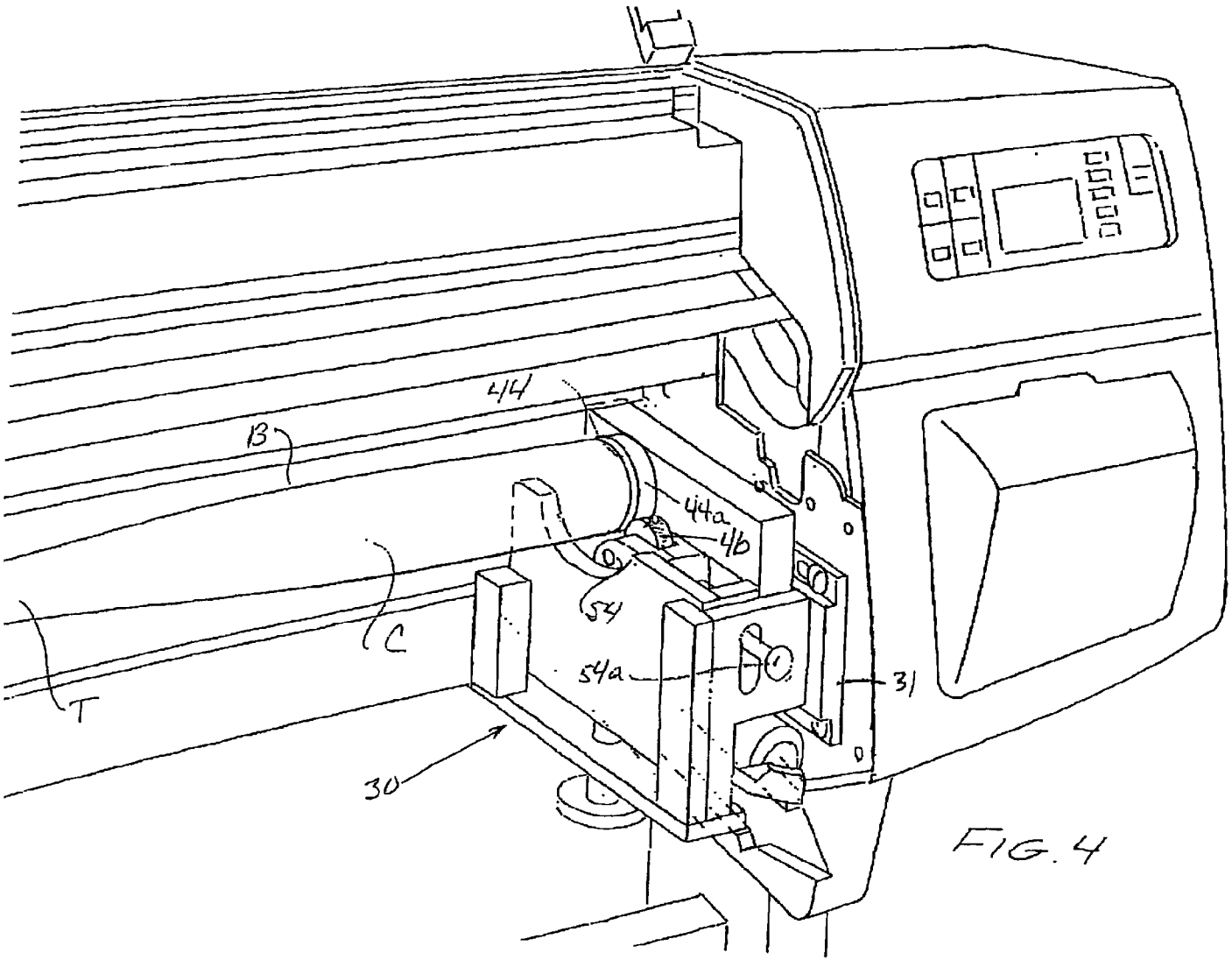

FIG. 4 is a generally perspective view of the right hand portion of the apparatus shown in FIG. 3A.

Figure 5:
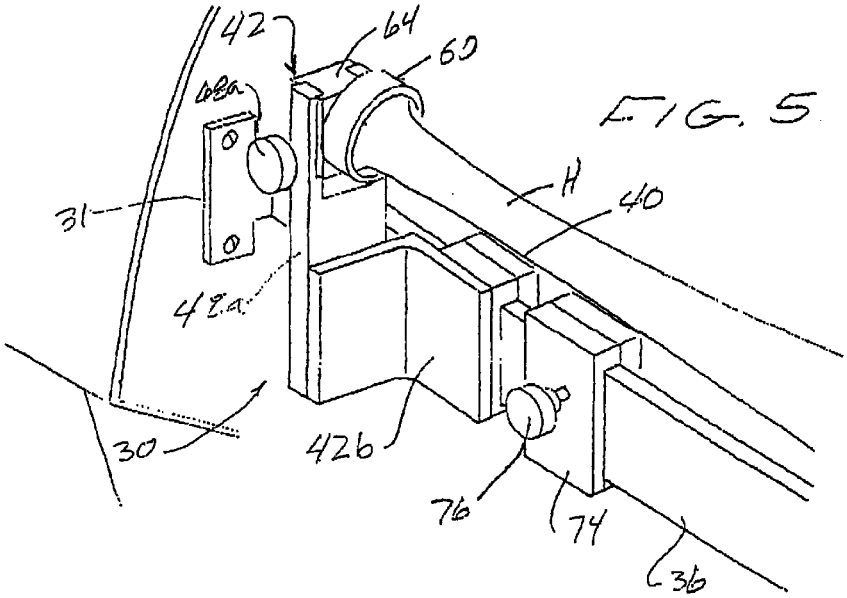

FIG. 5 is a generally perspective, fragmentary view of the left hand portion of the apparatus shown in FIG. 3 showing the manner in which the handle portion of the baseball bat is mounted within the article positioning subassembly.

Figure 6:
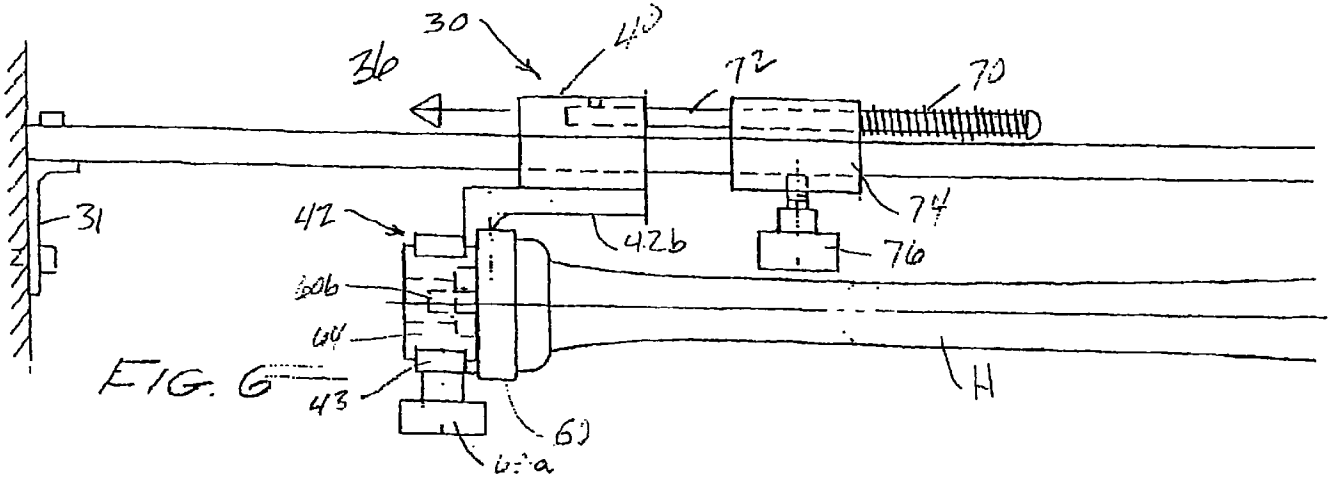
Figure 6A:
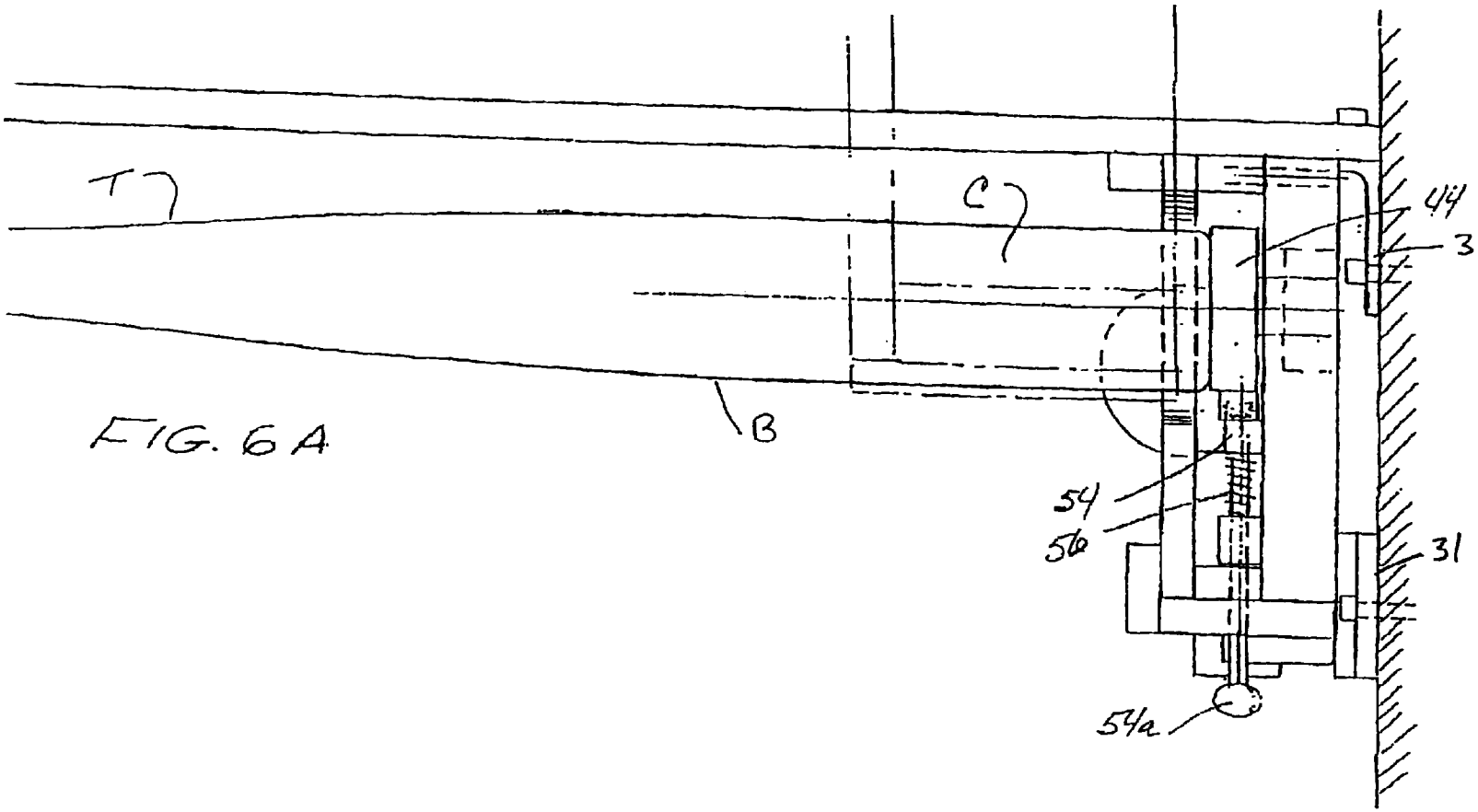

FIGS. 6 and 6A when considered together comprise a view taken along line 6—6 of FIGS. 3 and 3A.

Figure 7:
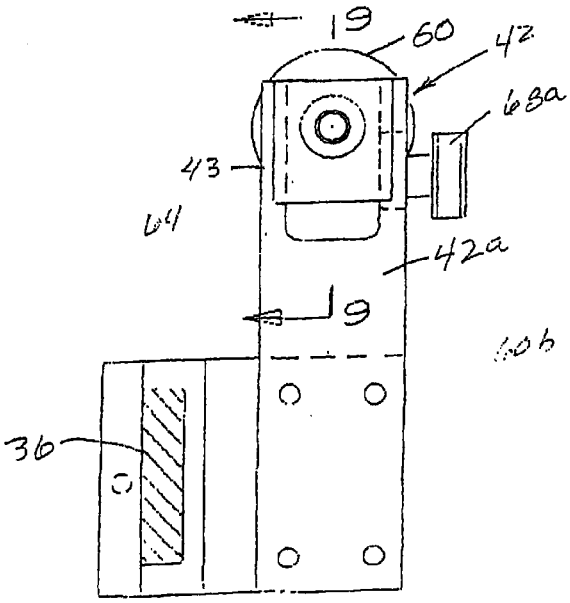

FIG. 7 is a cross-sectional view taken along lines 7—7 of FIG. 3.

Figure 8:
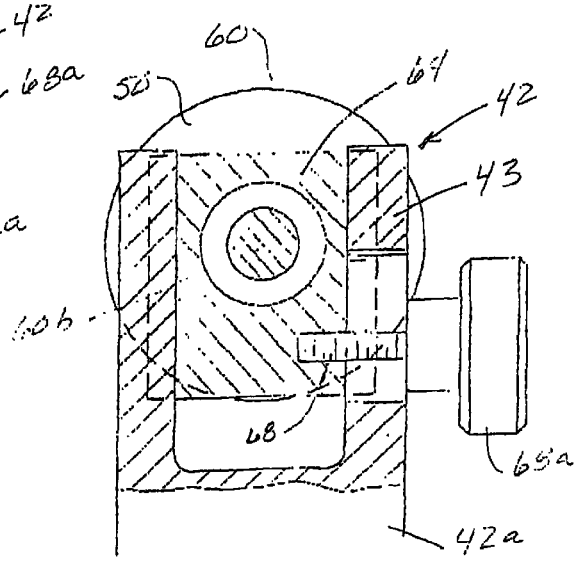

FIG. 8 is a cross-sectional view taken along lines 8—8 of FIG. 3.

Figure 9:
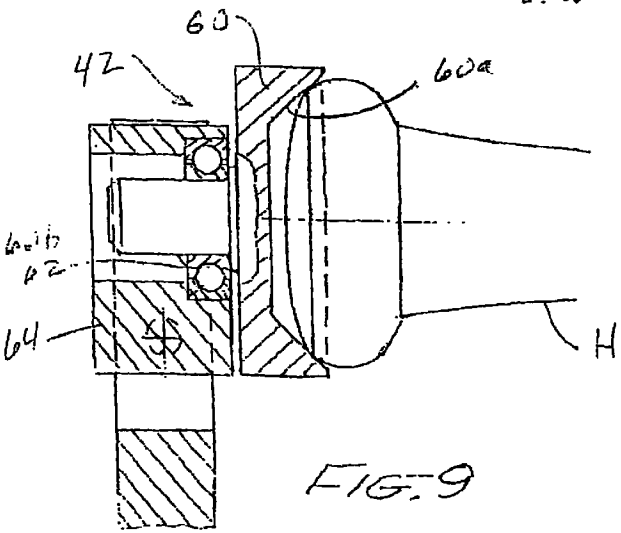

FIG. 9 is an enlarged cross-sectional view taken along lines 9—9 FIG. 3.

Figure 10:
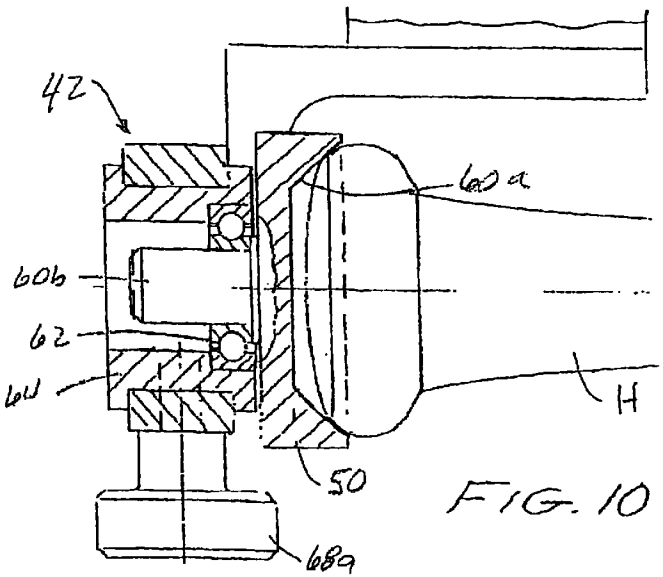

FIG. 10 is an enlarged cross-sectional view taken along lines 10—10 of FIG. 3.

Figure 11:
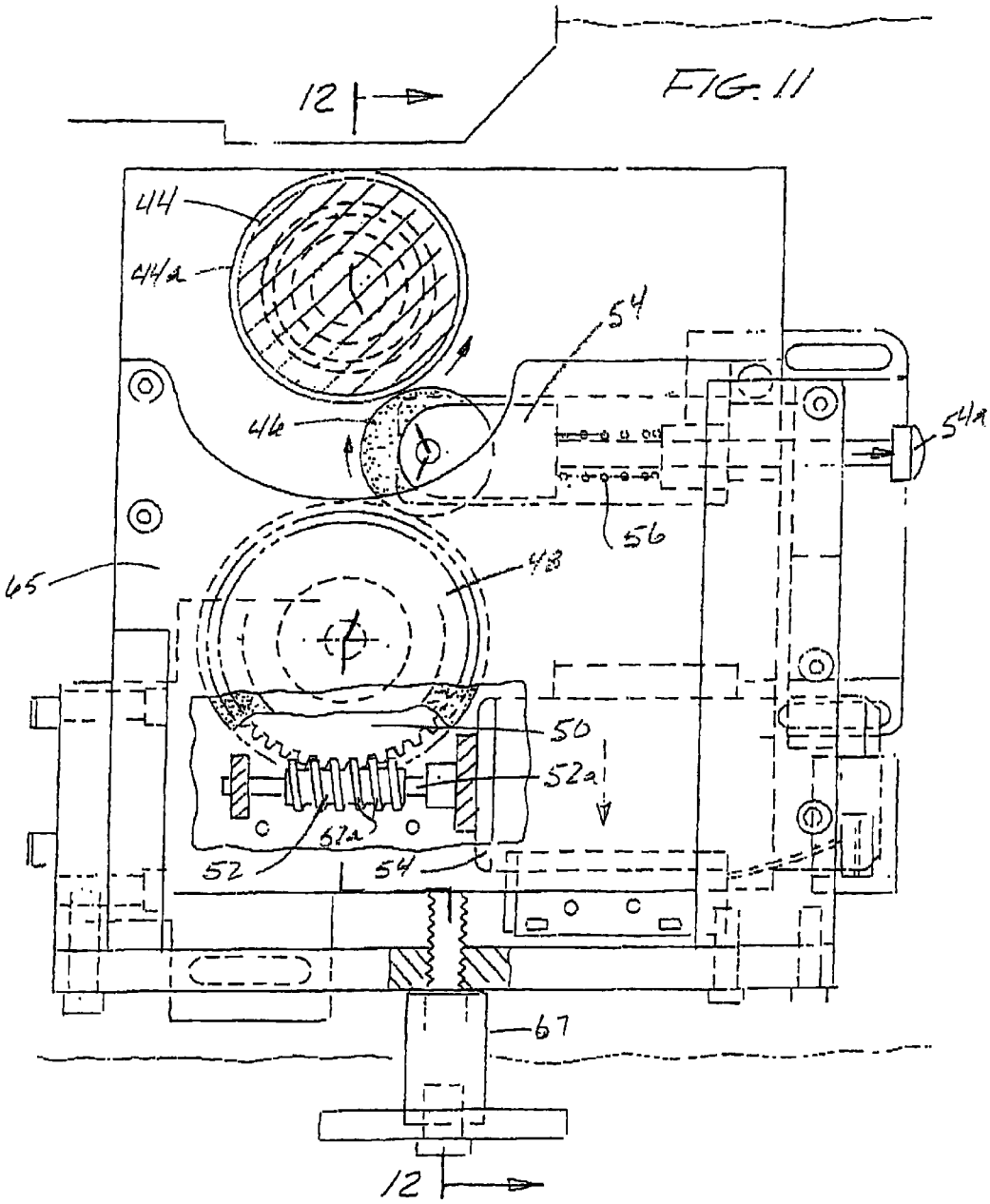

FIG. 11 is an enlarged cross-sectional view taken along lines 11—11 of FIG. 3A.

Figure 12:
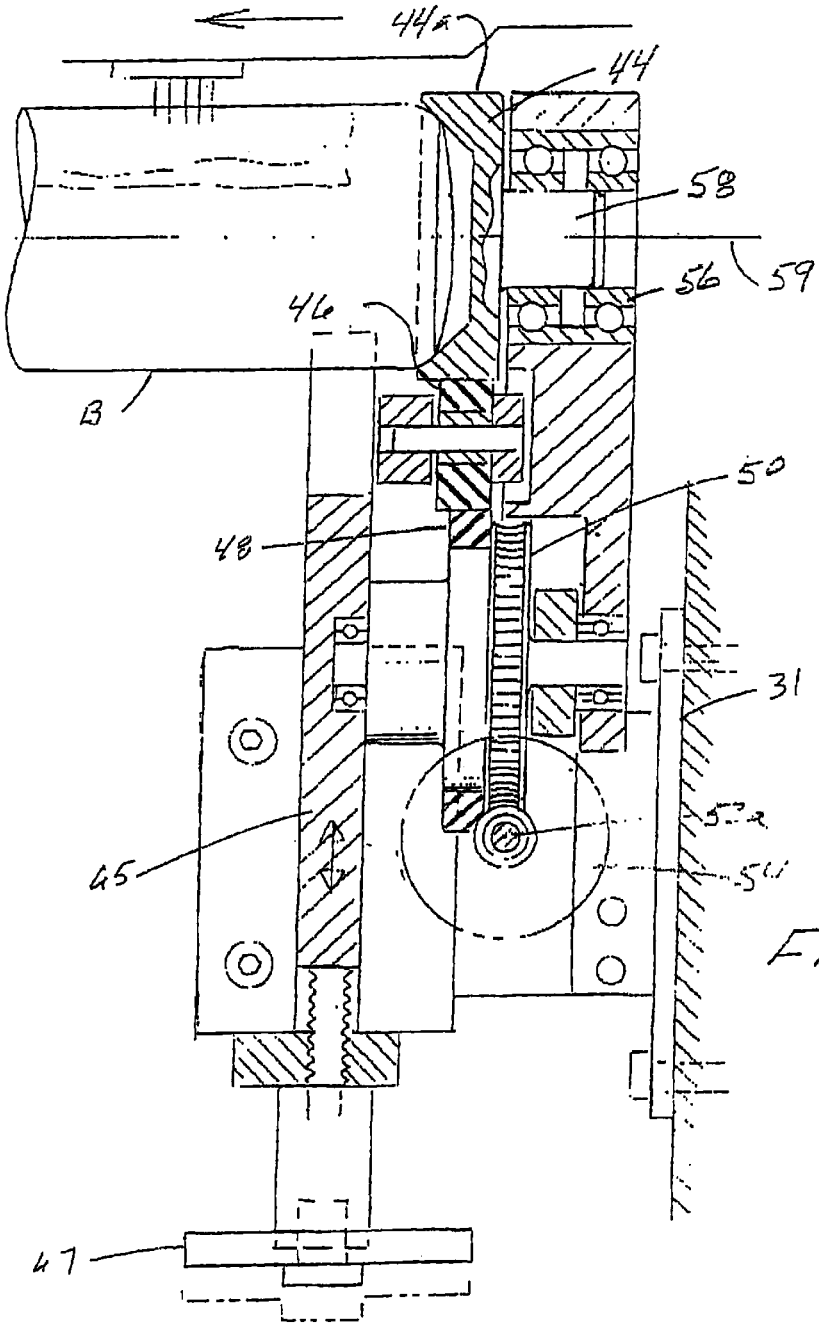

FIG. 12 is a cross-sectional view taken along lines 12—12 of FIG. 11.

Figure 13:
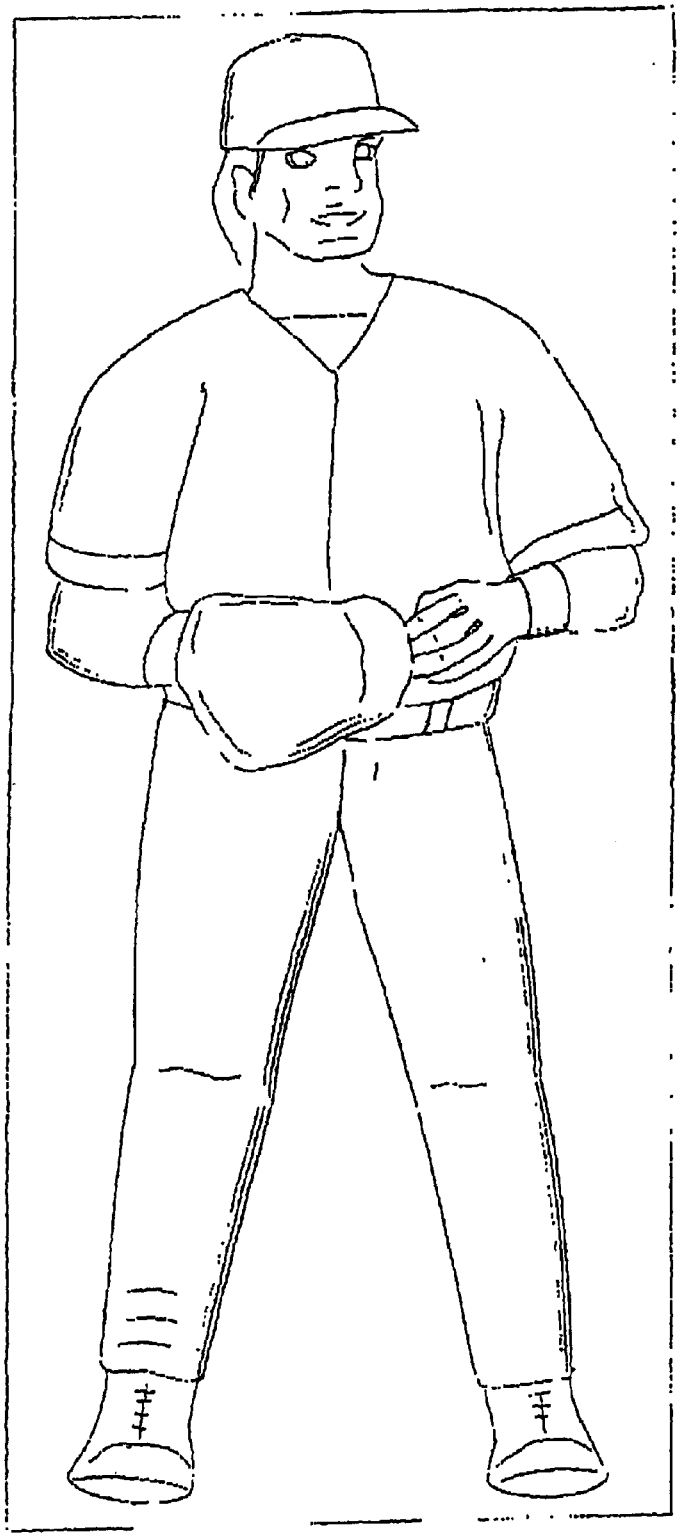

FIG. 13 is a generally diagrammatic view of an undistorted image or pattern that will be appropriately distorted for imprinting on an article such as a baseball bat in accordance with the method of the invention.

Figure 14:
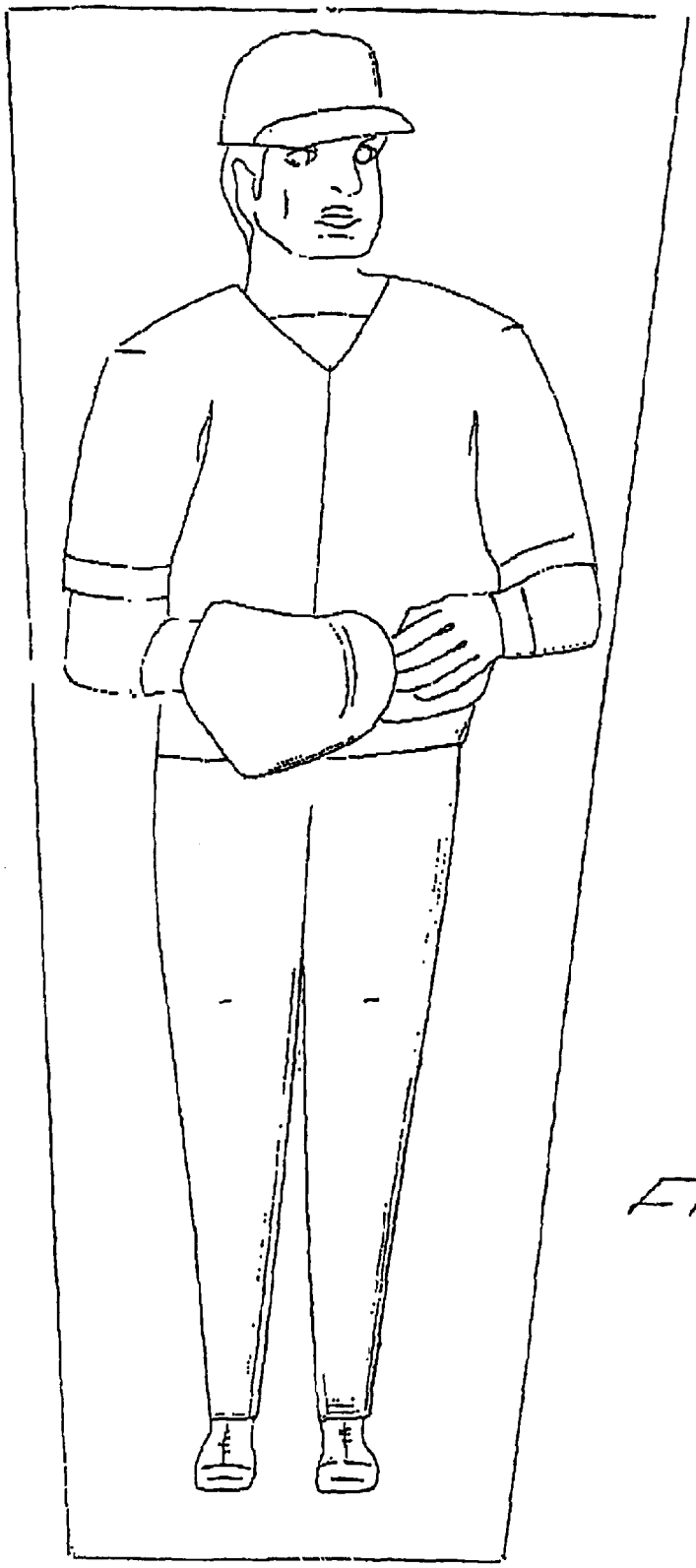

FIG. 14 is a generally diagrammatic view of the image shown in FIG. 13 that has been suitably distorted to enable it to be imprinted on a portion of the surface of a particular size of baseball bat.

Figure 15:
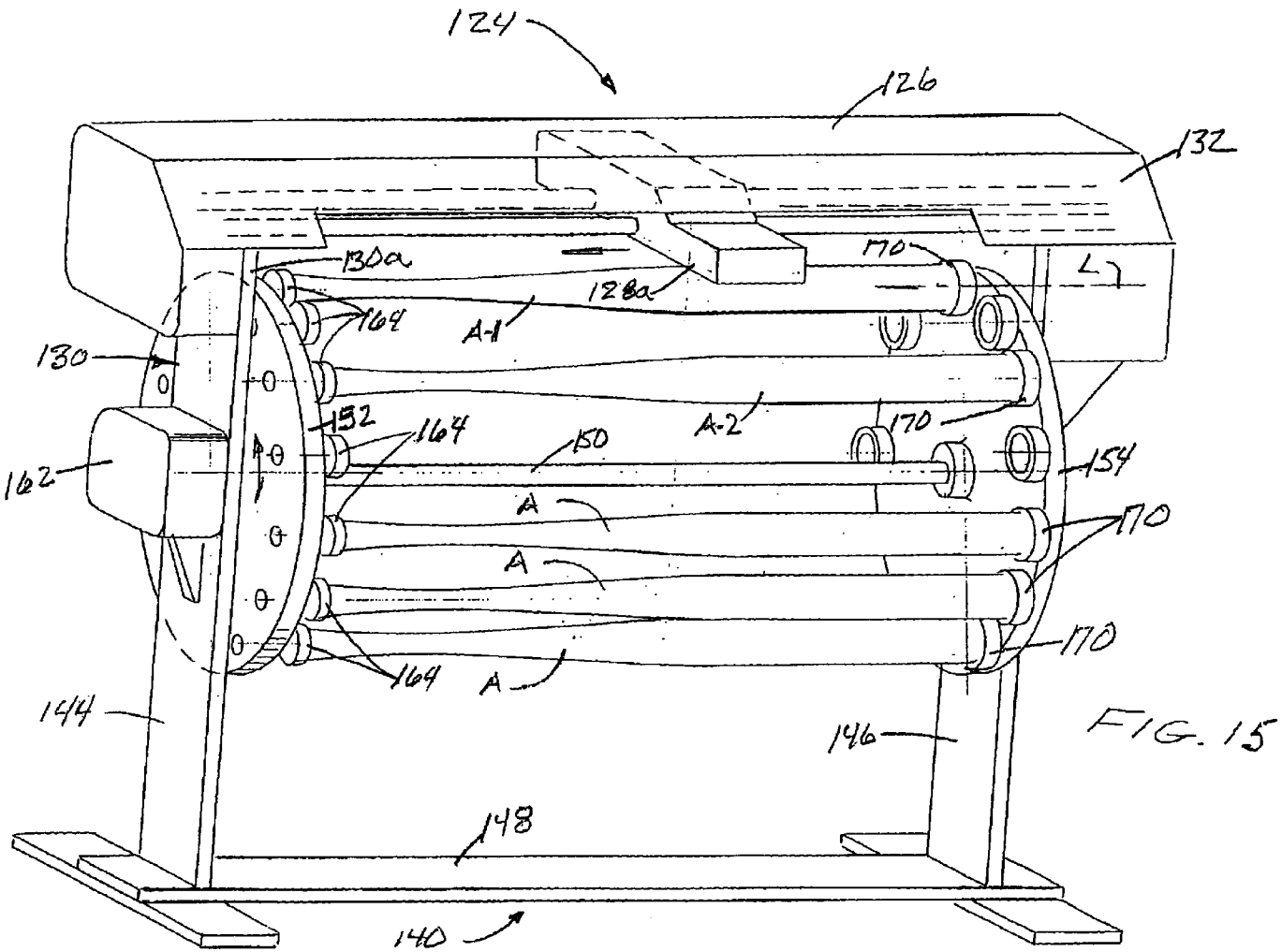

FIG. 15 is a generally perspective view of an alternate form of the apparatus of the invention for imprinting a predetermined pattern on a surface of a plurality of three-dimensional article such as a baseball bats.

Figure 16A:
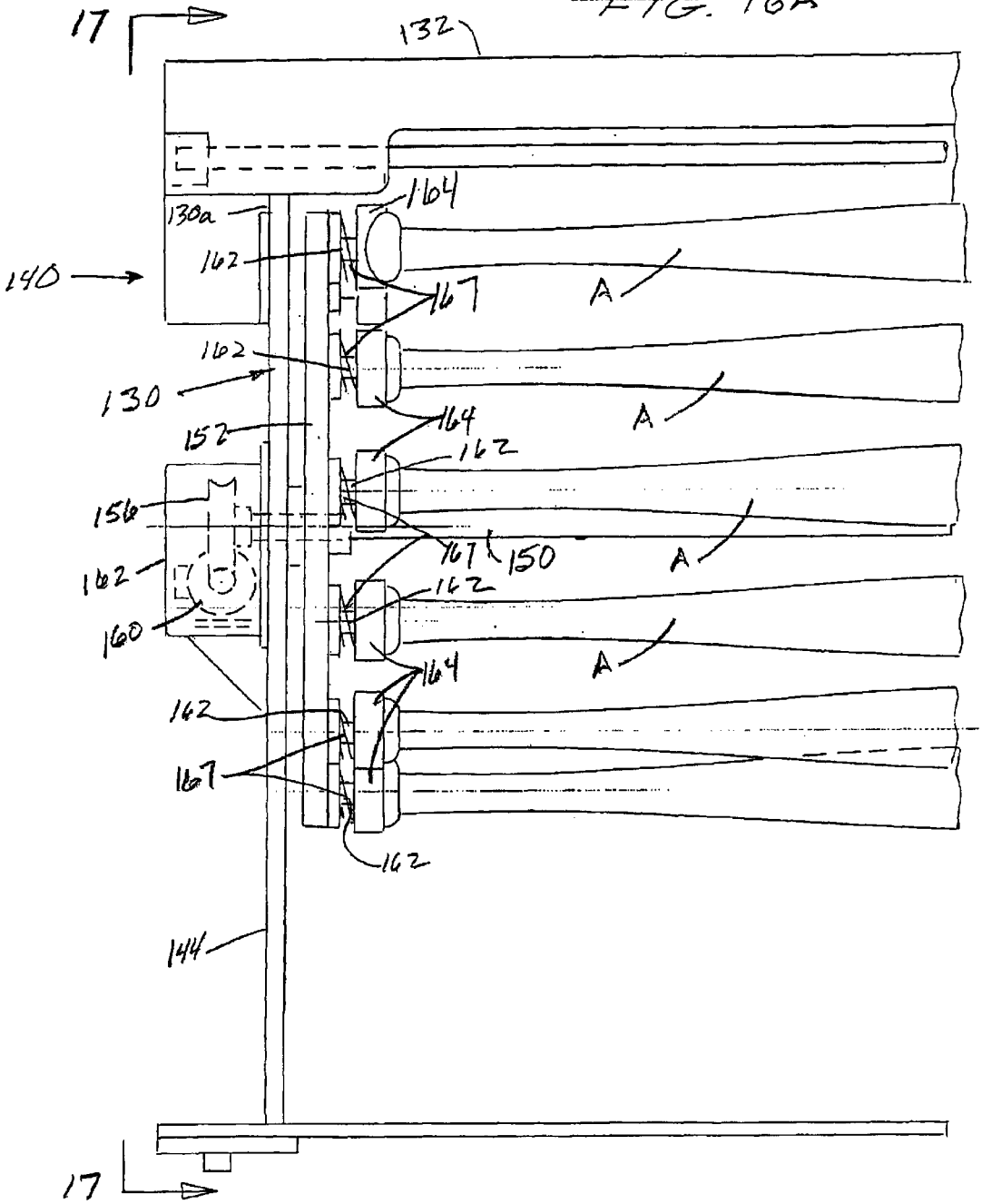
Figure 16B:
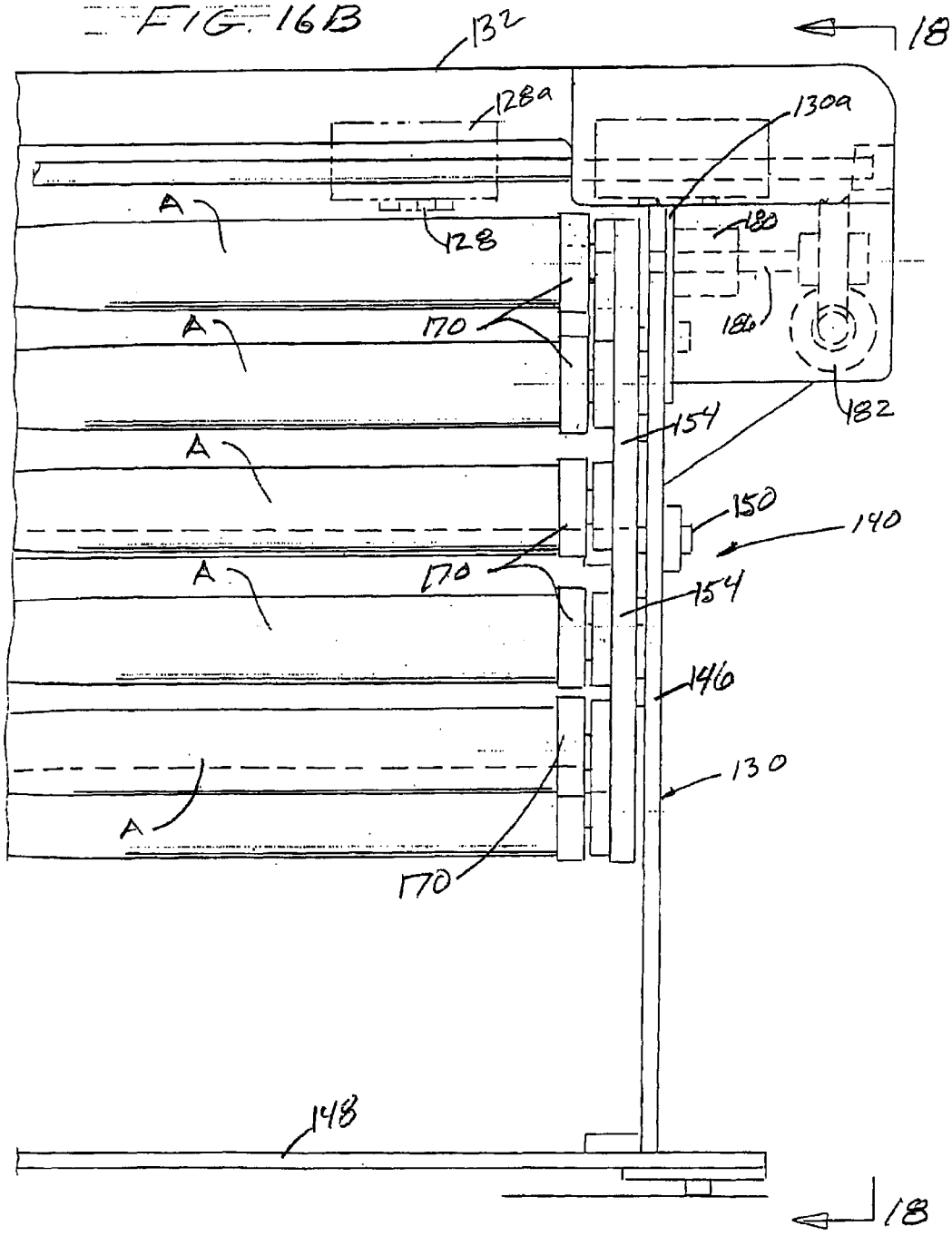

FIGS. 16A and 16B when considered together comprise is an enlarged front view of the apparatus shown FIG. 15.

Figure 17:
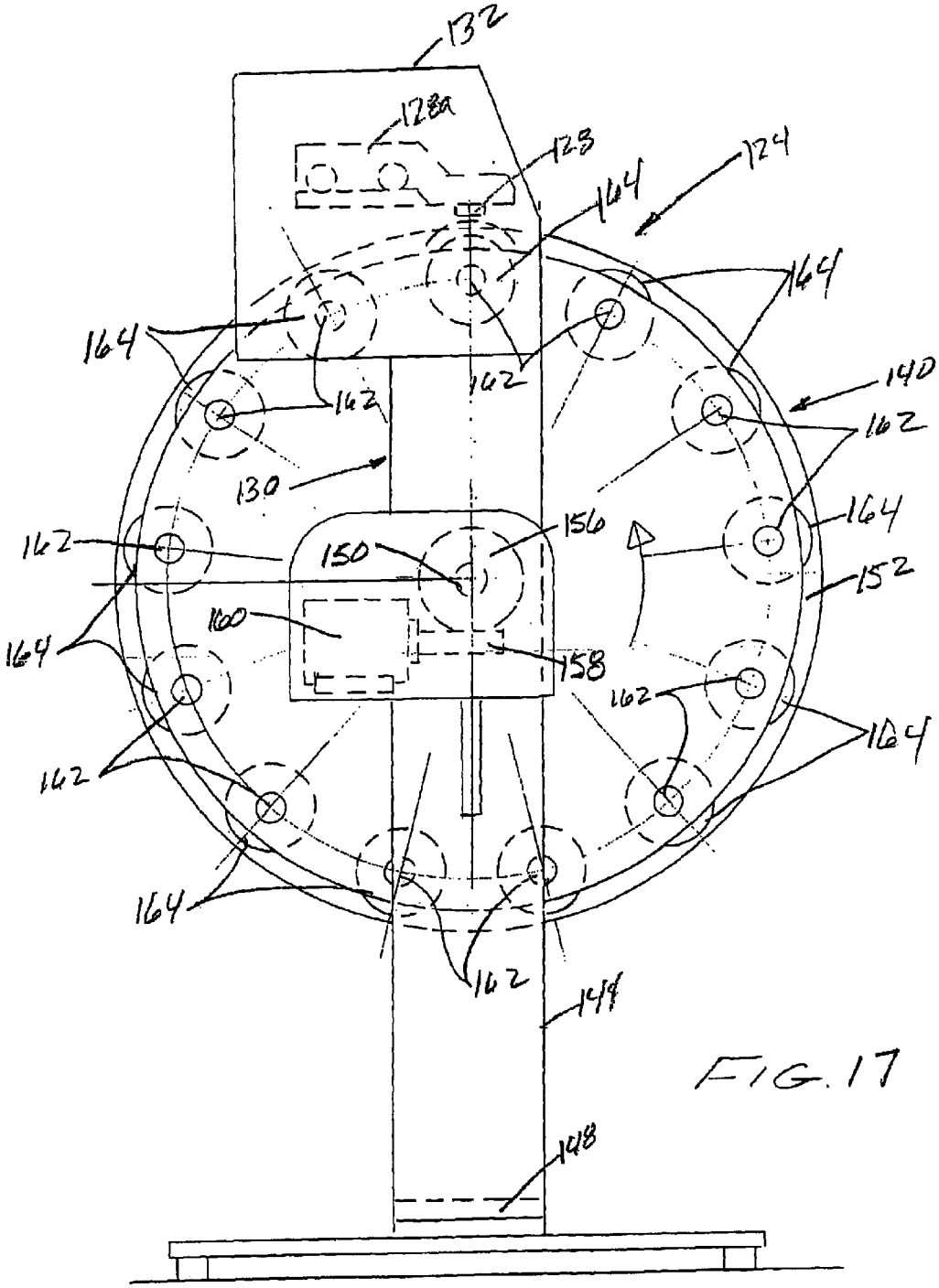

FIG. 17 is a cross-sectional view taken along lines 17—17 of FIG. 16A.

Figure 18:
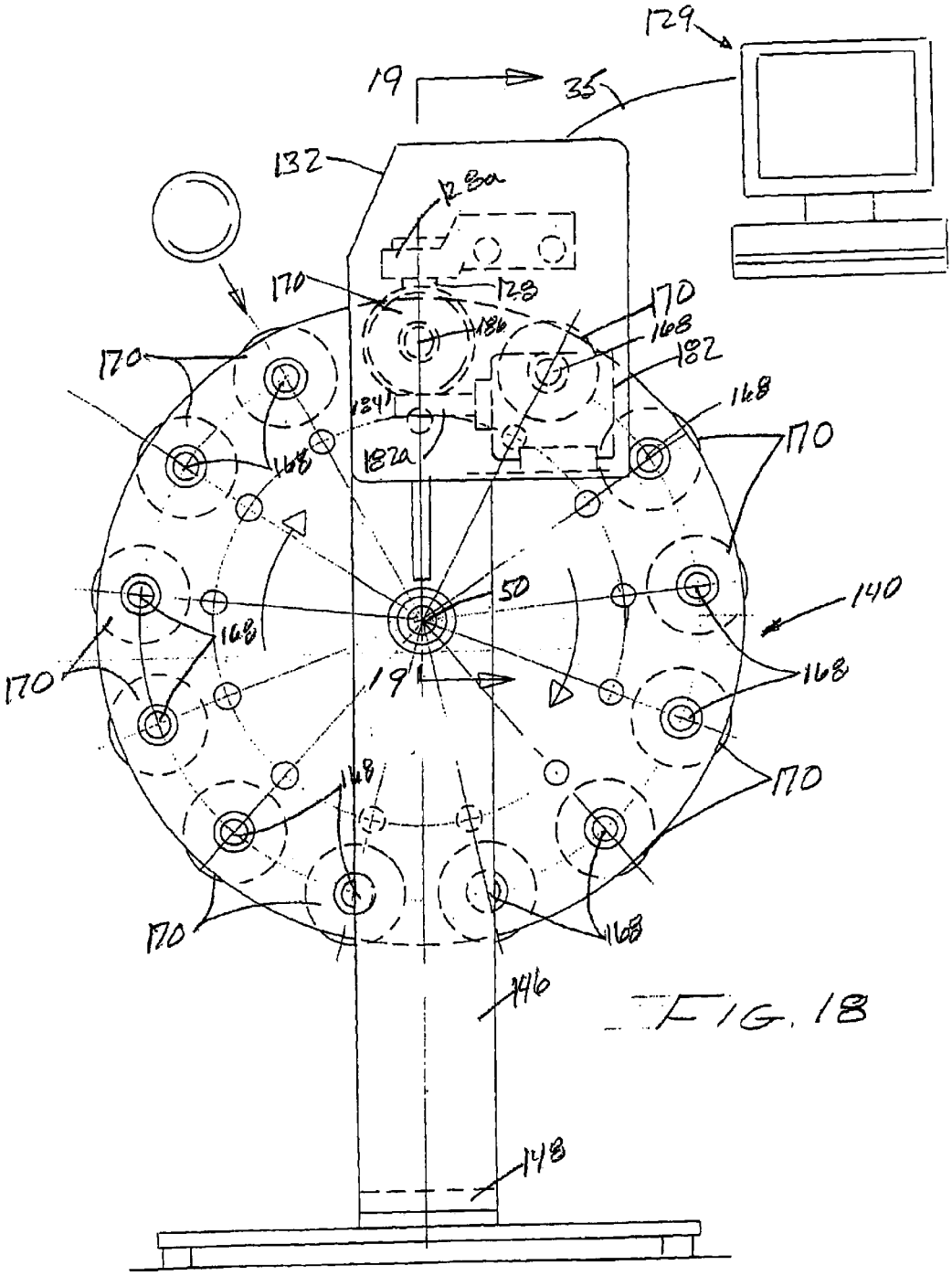

FIG. 18 is a cross-sectional view taken along lines 18—18 of FIG. 16B.

Figure 19A:
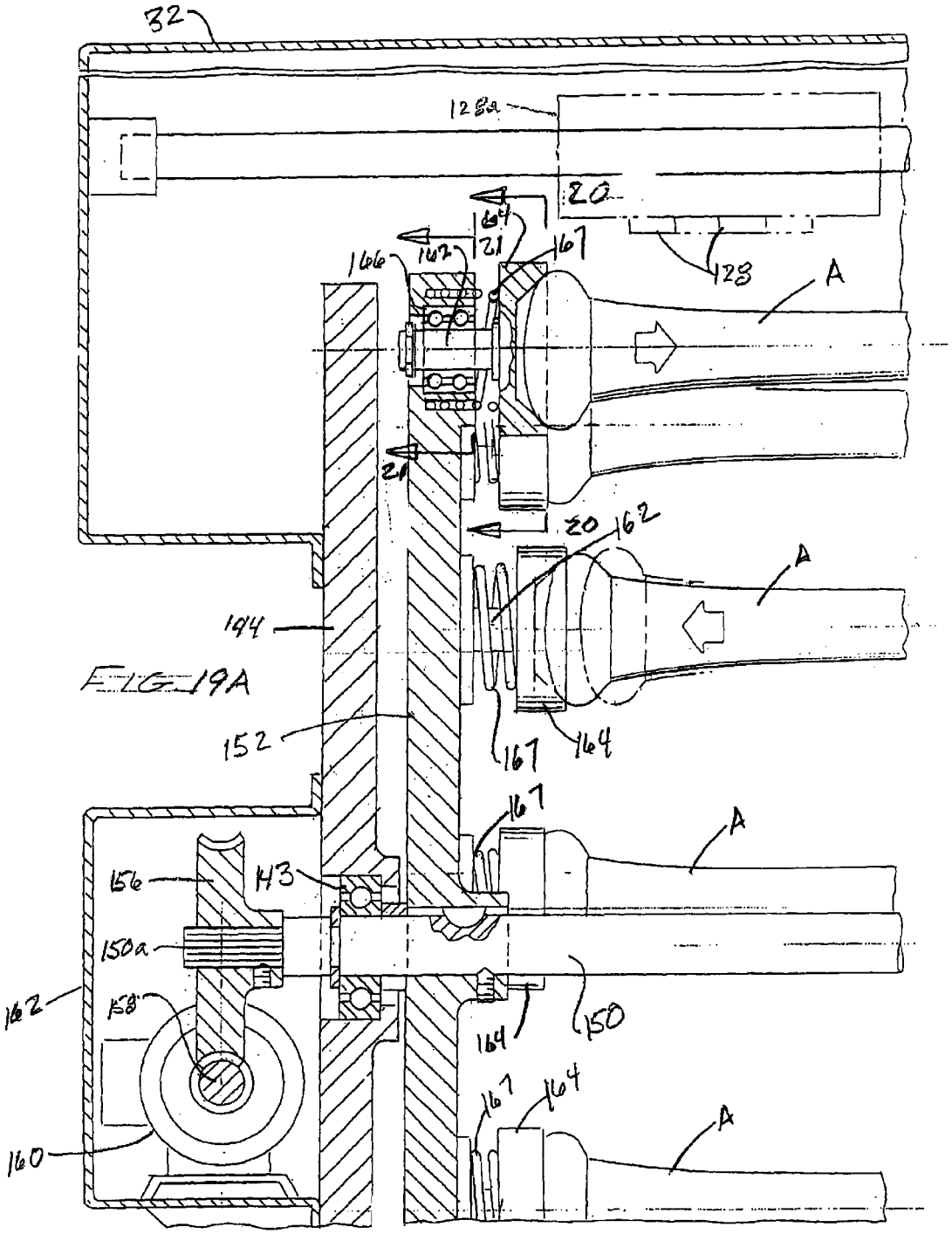
Figure 19B:
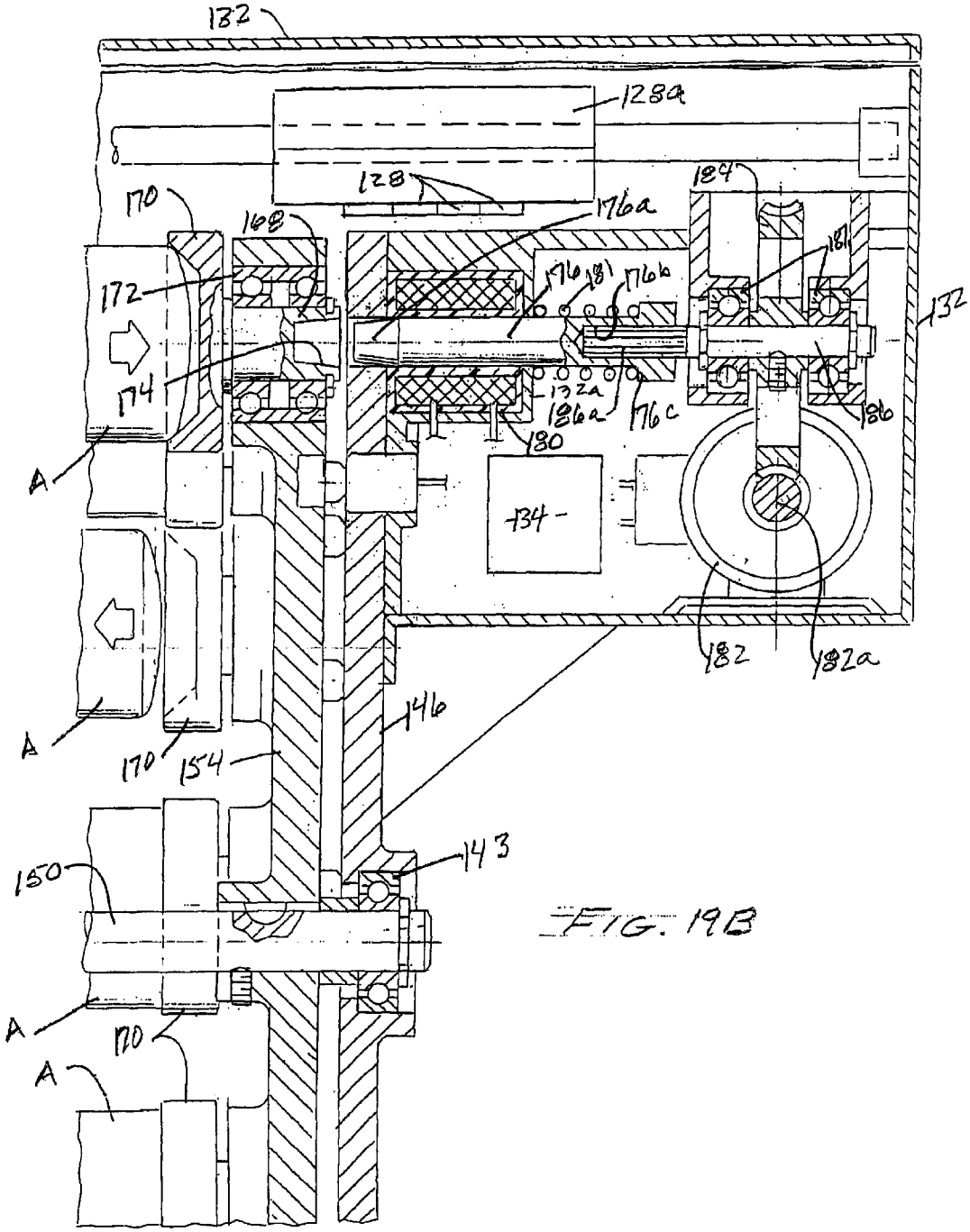

FIGS. 19A and 19B when considered together comprise a cross-sectional view taken along lines 19—19 of FIG. 18.

FIG. 20 is an enlarged, cross-sectional view taken along lines 20—20 of FIG. 19A.

FIG. 21 is an enlarged, cross-sectional view taken along lines 21—21 of FIG. 19A.

Figure 22:
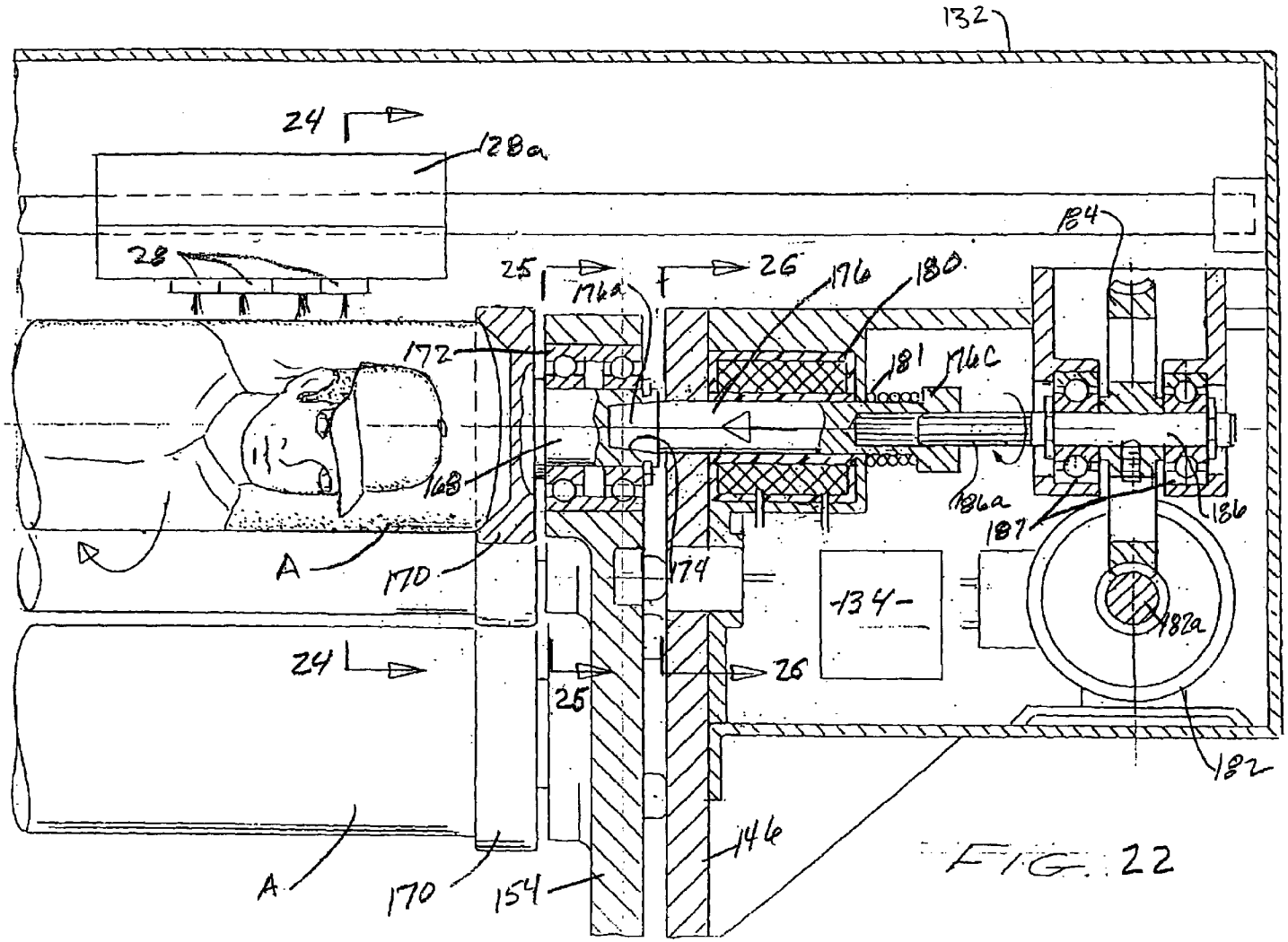

FIG. 22 is an enlarged cross-sectional view similar to the upper portion of FIG. 19B showing the commencement of the printing step of the method of the invention.

FIG. 23 is an enlarged cross-sectional view similar to the upper portion of FIG. 19B, but showing the solenoid operated drive shaft of the apparatus moved into a driving position.

Figure 24:
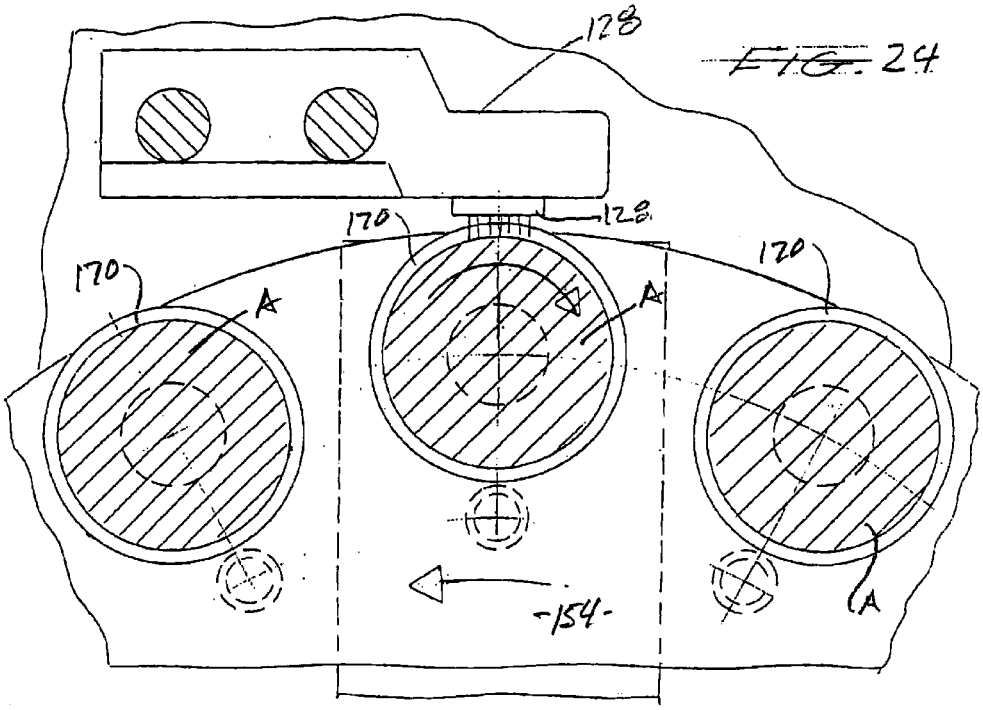

FIG. 24 is a cross-sectional view taken along lines 24—24 of FIG. 22.

Figure 25:
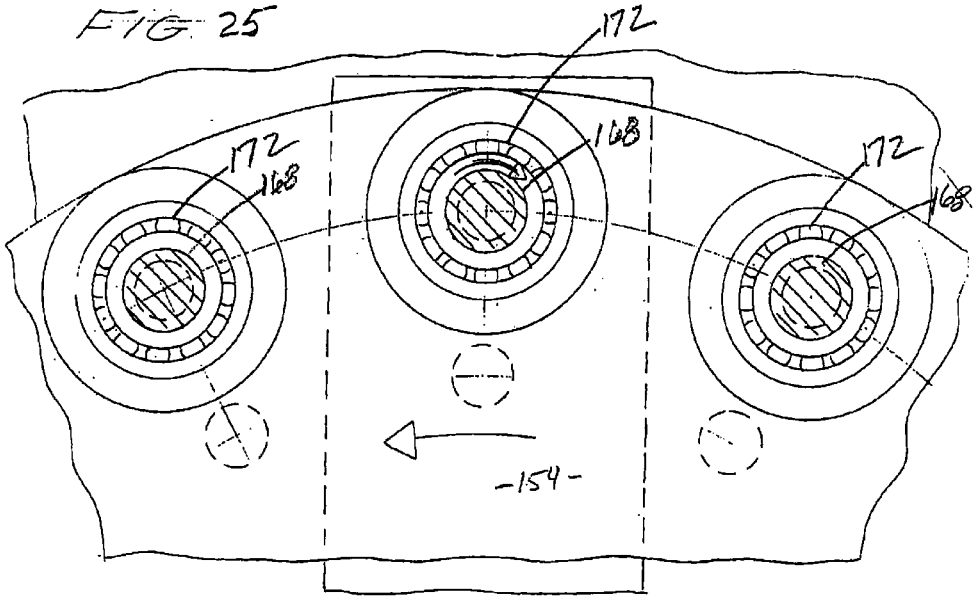

FIG. 25 is a cross-sectional view taken along lines 25—25 of FIG. 22.

FIG. 26 is a cross-sectional view taken along lines 26—26 of FIG. 22.

DESCRIPTION OF THE INVENTION

Figure 2:
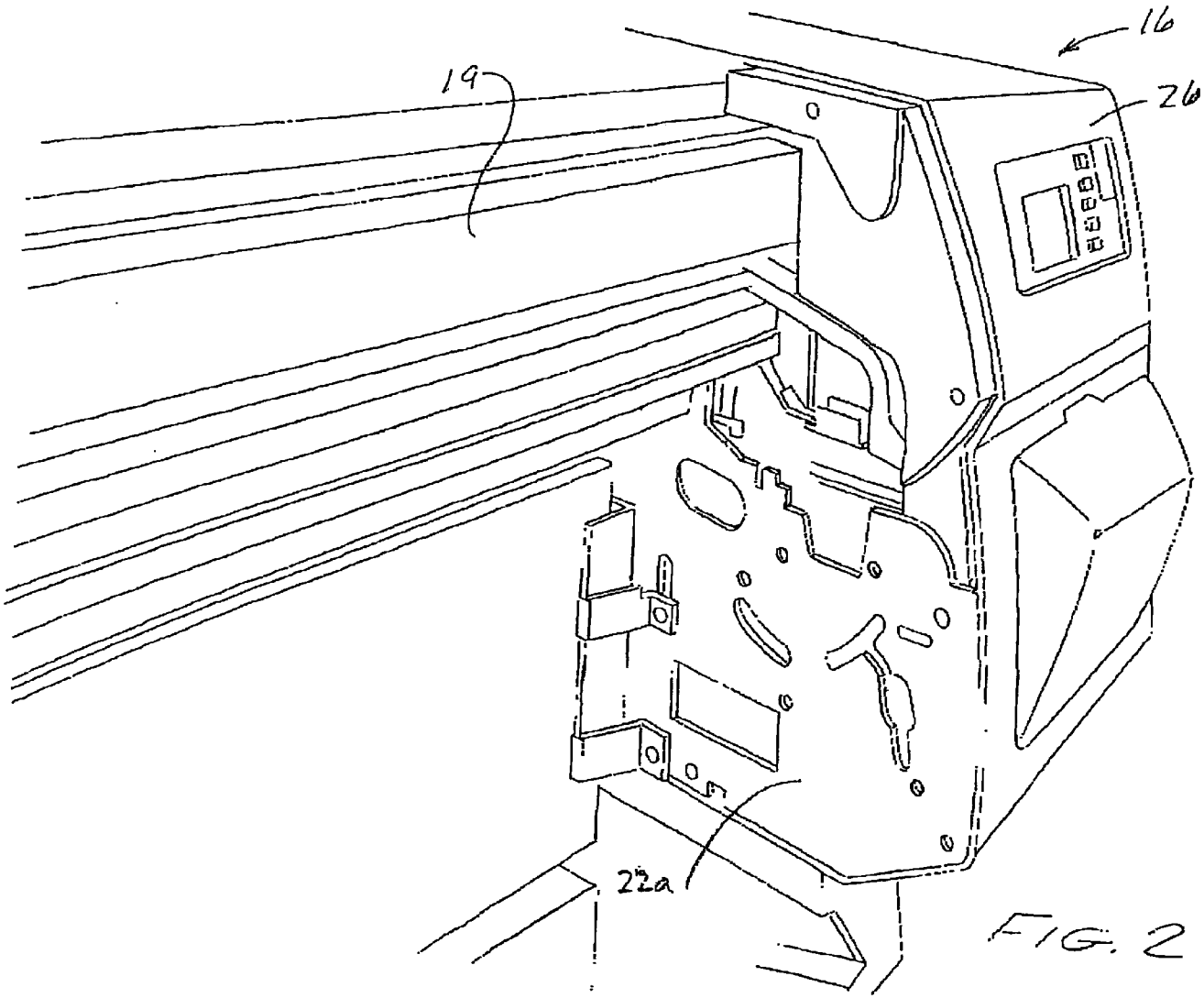
FIG. 2 is an enlarged, generally perspective view of the right hand portion of the modified commercially available plotter shown FIG. 1.

Referring to the drawings and particularly to FIGS. 3 and 3A, one form of the apparatus of the invention for imprinting a predetermined image or pattern on a three-dimensional article is there illustrated and generally designated by the numeral 14. The apparatus of this form of the invention is made up of two main components, one being a modified, commercially available type of microprocessor based, ink jet printer 16 (FIGS. 1 and 2) and the other comprising positioning means for holding, positioning, and rotating the article to be imprinted within the printer at a location proximate the color ink jet print heads 18 of the modified printer 16 (FIG. 3). The primary modification made to the commercial printer involves the removal of the drive roller assemblies and their related drive mechanisms from the lower portion of the printer housing. Once this is an accomplished the lower portion of the printer housing is open and has the configuration illustrated in FIG. 1 of the drawings.

While various commercially available ink jet printers and plotters can be used in combination with the positioning means of the invention, large-format and desktop printers manufactured and sold by The Hewlett-Packard Company as Designjet, Models 1050C/1055CM, 1120C and 1220C have proven satisfactory. The Designjet printer is a microprocessor-based digital printer that receives plotting instructions from an associated host computer 20 (FIG. 1). It is also to be understood that either a printer or a plotter apparatus could be specifically designed for a given application and could be used with positioning means of the character presently to be described in performing the method of the invention. Such an apparatus would preferably incorporate a reciprocally movable cartridge assembly that could imprint images on a stationary object.

As best seen in FIG. 1, modified printer 16 comprises a console-type housing 22 having a base 24, a covering 26 superimposed over base 24 and a control panel 28 which houses the control circuitry of the printer. Computer 20 functions to communicate to the control circuitry of the printer the predetermined image or graphic that is to be imprinted on the three-dimensional article. The image or graphic can be scanned or can be originally generated in the computer environment with specialized software. Typically, the computer image or graphic is stored on a hard drive and sent via a cable 28 to the control circuitry of the printer 16. Techniques for scanning or originally generating the image or indicia or be imprinted on the three-dimensional article are well known to those skilled in the art.

Data transfer is controlled by the computer 20, which generates and transmits to the control circuitry of the printer the necessary timing signals to properly sequence the processing of data and instructions to the printer. The printer memory typically contains the operating system to control printer operation using the control panel. The ink jet print heads 18, which upon command, travel longitudinally of the print zone of the printer along the print head carriage 19, are preferably of very high resolution, such as the Designjet ink jet printers sold by Hewlett-Packard. Examples of the design and operation of other prior art print heads, reservoirs and printers are described in U.S. Pat. Nos. 4,593,292; 4,459,601; 4,523,200; 4,580,147; and 4,646,106. Because of the pertinency of the aforementioned patents, each of the patents is hereby incorporated by reference as though fully set forth herein.

The ink, which is dispensed by the ink jet print heads, can be either solvent or waterbased and is carried by the cartridges in a manner generally disclosed in U.S. Pat. Nos. 4,646,106 and 4,592,292. The carriage of the printers typically contains a printed circuit board, which controls the firing of the nozzles in the ink jet print heads. In the apparatus of the present invention, the motor is also controlled from the main printed circuit assembly by the microprocessor 18 via the control circuitry housed within control panel 26. Details concerning the construction and theory of operation of the Designjet Models 1050C/1055CM, 1120C and 1220C printers and details of the control circuitry thereof are readily obtainable from The Hewlett-Packard Company of San Diego, Calif.

Considering now the important article positioning means of the invention that is mounted within the modified printer housing 22, this means here comprises an article positioning assembly, generally designated by the numeral 30, that is mounted within the lower portion of the modified printer housing using appropriate connecting hardware 31 (FIGS. 6 and 6A). In the form of the invention illustrated in the drawings, the article positioning assembly has a first end portion 32 and a longitudinally spaced, second, or left end portion 34 (FIGS. 3 and 3A). As shown in FIG. 3A, first end portion 32 includes first gripping means for gripping the first end of the three-dimensional article to be imprinted and rotating means for controllably rotating the three-dimensional article relative to the ink jet cartridges 18. The second end portion 34, as shown in FIG. 3, includes second gripping means for gripping the second end of the three-dimensional article to be imprinted and length adjustment means for adjusting the distance between first and second gripping means. Second end portion 34 also includes height adjustment means for adjusting the height of the second gripping means.

The positioning means of the present form of the invention further comprises a guide member 36 that extends longitudinally of the modified printer housing and also comprises a carriage 40 that is slidably movable along guide member 36. A support arm 42*a* of a support arm assembly 42 is connected to carriage 40 by an angle bracket 42*b* (FIG. 5) and the second gripping means of the apparatus is connected to the support arm in the manner as seen in FIGS. 3, 5 and 6.

As previously mentioned, minimum modification of the commercially available Designjet printer is required to enable it to accept the article positioning means of the invention. Basically, all that is required is to remove the media drive mechanisms, which manipulate the media, such as planar sheets of material which are to be imprinted and to add connectors to the spaced apart printer end walls 22*a* and 22*b* to permit connection of the article positioning means thereto (FIG. 1).

As shown in FIGS. 3A and 4 the first gripping means of the apparatus includes a first generally cup shaped member 44 having a peripheral surface 44*a*. The rotating means of the apparatus for rotating the article to be imprinted here comprises an idler wheel 46 that is disposed in engagement with peripheral surface 44*a* of cup shaped member 44 for imparting rotation thereto upon rotation of a drive wheel 48. As best seen in FIGS. 11 and 12, the toothed portion 50 of the drive wheel 48 is connected to a rack 52 housing teeth 52*a*. Rack 52 is mounted on a shaft 52, which is rotated by motor means here provided as a conventional electric motor 54.

An important feature of the apparatus of the invention resides in fact that idler wheel 46 is adjustable relative to both wheel 48 and cup 44 so that cups of various sizes can be substituted for cup 44 in order to accept bats having either larger or smaller barrels. More particularly, as best seen in FIG. 11, idler wheel 46 is mounted for rotation on an idler wheel support carriage 54 that is reciprocally movable from a first position shown in FIG. 11 to a second retracted position wherein carriage 54 moves to the right has viewed in FIG. 11. Biasing means, shown here as a coil spring 56, functions to urge carriage 54 into engagement with cup 44 and wheel 48, that is to the left as viewed in 11. It is apparent that by pulling on gripping portion 54*a* (FIG. 4), idler wheel 46 can be moved to the right as viewed in FIG. 11. This permits cup 44 to be removed from the bearing 56 that supports it (FIG. 12) so that it can be replaced by an alternate, larger for smaller cup. However, regardless of the size of the holding cup, idler wheel 46 will be continuously urged into pressural engagement with drive wheel 48 and with the cup that is holding the bat that is to the imprinted. As shown in FIG. 12, stub shaft 58 is affixed to an extends from cup 44 for insertion into bearing 56. Bearing 56 is located so that the article to be imprinted, in this case a baseball bat B, is rotated about the longitudinal axis 59 of the bat, that resides within a first plane, that is parallel with a second, spaced-apart plane within which the ink jet cartridges travel.

As illustrated in FIGS. 3 and 3A, baseball bat "B" includes a handle portion "H", a cylindrically shaped barrel portion "C", and a tapered intermediate portion "T" which is located between handle portion "H" and cylindrically shaped barrel portion "C". When this type of three-dimensional article is to be imprinted, a generally cup shaped member 60, which comprises a part of the second gripping means is adapted to support handle portion "H" of the three-dimensional article in the manner shown in FIG. 3. Similarly, the previously identified generally cup shaped member 44 of the first gripping means is adapted to support the end of the barrel shaped portion "C" of the baseball bat. As previously described, when the barrel shaped portion "C" of the baseball bat to be imprinted is either larger or smaller in diameter from that shown in the drawings, cup shaped member 44 can be removed and a larger or smaller cup shaped member can be substituted therefor. Accordingly, bats having barrel portion of various diameters can readily be accommodated by replacing cup shaped member 44 with an alternate, appropriately sized cup shaped member. As is readily apparent from a study of FIGS. 11 and 12, by changing the size of the cup shaped member that holds the first end, or barrel of the bat, the speed of rotation of the bat about its longitudinal axis is automatically adjusted. More particularly, where the motor 54 rotates shaft 52*a* at a constant speed, the larger the cup that supports the barrel of the bat, the slower will be the speed of rotations of the bat about axis 59. The effect of this change of rotational speed will later be discussed.

Considering now in greater detail the second gripping means of the invention this means here comprises a generally cup shaped member 60 that includes an article gripping portion 60*a* and an outwardly extending shaft portion 60*b* (FIG. 9). Shaft portion 60*b* is mounted for rotation within a bearing 62 that is carried by a holding block 64. Holding block 64 is, in turn, slidably received within the generally yoke shaped portion 43 of upstanding arm 42*a* of support arm assembly 42 (FIG. 8). Holding block 64, which forms the part of the height adjustment means of the invention for raising or lowering the height of cup 60 relative to the plane of travel of the ink jet cartridges, is held securely in position within yoke portion 43 by a threaded set screw 68 having a finger gripping head portion 68*a* at a selected height so as to maintain the longitudinal axis of the bat parallel with the path of travel of the ink jet cartridges. In this regard, it is also possible to adjust the height of cup 44 of the first gripping means, if so required, by raising or lowering a support plate 65 by a second height adjustment means. This second height adjustment means here comprises, in addition to support plate 65 an adjusting screw 67 that acts on plate 65 in the manner depicted in FIGS. 11 and 12.

In using the apparatus of the invention to accomplish one form of the method of the invention, shaft 58 of an appropriately sized cup assembly 44 is first mounted within bearing 56. This done, the longitudinal position of the second gripping means of the invention is adjusted using the length adjustment means of the invention to position cup 60 of the second gripping means at the correct spaced-apart location to accept the bat to be imprinted. In this regard, is to be noted that the length adjustment means includes biasing means, shown here in the form of a coil spring 70 (FIG. 6). Spring circumscribes an elongated rod 72, one end of which is connected to carriage 40, and in this way functions to urge the second gripping means, including cup 60, toward the first gripping means, or to the right as viewed in FIG. 6. As shown in FIG. 6, rod 72 is mounted within an adjustment block 74 that can be selectively positioned along guide 36 by loosening a setscrew 76 to roughly position cup 60 at a location approximately the length of the bat "B".

In using the apparatus of the invention, the length of the bat to be imprinted, as well as the diameter of the barrel portion C of the bat is first determined. This done an appropriately sized holding cup, such as cup 44, is inserted into bearing 56 in the manner shown in FIG. 12. In order to insert the holding cup 44 into bearing 56, idler wheel 46 must be urged to the right as viewed in FIG. 11 against the urging of spring 56. When the cup is correctly positioned within bearing 56 and the pressure exerted against idler wheel 46 is relaxed, spring 56 will urge the idler wheel into driving engagement with the peripheral surface 44*a* of the holding cup. As previously mentioned, the larger the holding cup the slower will be the rotation of the bat. Conversely, the smaller the holding cup the faster will be the rotation of the bat.

After the correct cup assembly 44 is in place, carriage 40 of the positioning means is moved along guide 36 to a location wherein the extremity of the handle of the bat can be inserted into holding cup 60 (FIG. 3). At this same time, if so required, block 64 can be moved upwardly or downwardly by loosening set screw 68 in order to insure that the longitudinal axis of the bat is precisely parallel to the longitudinal path of travel of the ink jet heads. It is to be noted that with the bat secured within the positioning means in the manner shown in FIG. 3 and 3A, the biasing means or spring 70 of the length adjustment means will continuously urge cup 60 into pressural engagement with the extremity of the handle portion of the bat so that cups 44 and 60 are in secure frictional engagement with the ends of the bat.

Following the correct positioning of the bat "B" within the positioning means, energization of motor 54 will cause rotation of shaft 52*a* and screw 52 which will, in turn, cause rotation of drive wheel 48 at a constant speed of rotation. As previously described herein, rotation of drive wheel 48 will, cause rotation of idler wheel 46 and the concomitant rotation of holding cup 44. Rotation of holding cup 44, which is in frictional engagement with the bat, will cause the bat to rotate about axis 59 at uniform rate that is governed by the diameter of the barrel portion of the bat. In this regard, when the image to be printed is, by way of nonlimiting example, a depiction of a human figure, such as a baseball player of the character shown in FIG. 13, the image is either scanned or originally computer generated using specialized software of a character well known to those skilled in the art. Because of the tapered configuration of the bat, it is obvious that the image as shown in FIG. 13, which is bounded by a rectangle "R" could not be imprinted on the bat because the image does not conform to the surface to be imprinted. This is due to the fact that, if the surface of the bat that is to be printed is projected into a planar configuration, the configuration would obviously be non-rectangular in shape. Therefore it is necessary to produce a distorted image that is of the character generally depicted in FIG. 14. As indicated in FIG. 14, the distorted image, which now generally conforms to the planar projection of the surface to be imprinted, is bounded by a trapazoid with the lower portion of the image being substantially narrowed so as to conform to the tapering of the bat. When this distorted image is printed by the printer in accordance with appropriate instructions given by to the control circuitry of the printer by host computer 20, the image will be neatly wrapped around the barrel as well as the tapered and handle portions of the bat to produce a desired nonoverlapping result. Image distortion of the general character shown in FIG. 14 can be easily accomplished by those skilled in the art using several types of readily commercially available morphing type software, to create a file that is readable by the control circuitry of the modified microprocessor based printer being used. Experience has shown that by way of non-limiting example, photo editing software such as that sold under the name and style "COREL" and "ADOBE PHOTO SHOP" can be used to appropriately distort the image to be imprinted.

The nature and extent of the distortion of the image to be imprinted is, of course, dependent on the configuration of the article to be imprinted. When the article has the configuration of a baseball bat, the bat must first be dimensionally analyzed to determine the character of the surface of the bat that is to be imprinted. Such an analysis can readily be accomplished by those skilled in the art and typically involves a determination of the diameter of the barrel portion of the bat and the degree of reduction in diameter or extent of taper of the tapered and handle portion upon which the image is to appear. Such a dimensional analysis of a baseball bat is relatively simple and need not be particularly precise so long as the surface to be imprinted can be projected into a planar configuration of the general character that is depicted in FIG. 14. Once the distorted image is created and appropriately loaded into the printer and the bat is rotated in the manner previously described, the ink cartridges will move through the print zone in a conventional manner and will appropriately deposit ink onto the surface of the bat to create the desired appropriately distorted image. More particularly, as the bat rotates, the control circuitry of the printer responding to the instructions received from the preprogrammed host computer 20 will direct the ink jet heads to controllably deposit ink onto the surface of the bat in accordance with the predetermined software that has been developed to produce the desired image on the baseball bat.

Referring next to FIGS. 15 through 26, an alternate form of the apparatus of the invention for imprinting a predetermined image or pattern on three-dimensional articles is there illustrated and generally designated by the numeral 124. The apparatus of this form of the invention is made up of two main components, one being a modified, commercially available type of microprocessor based, ink jet printer 126 (FIGS. 15, 16, and 17) of the general character previously described and the other comprising positioning means for holding, positioning, and rotating the articles to be imprinted at a location proximate the ink jet print heads 128 of the modified printer 126 (FIGS. 16B and 24).

While various commercially available ink jet printers and plotters can be used in combination with the positioning means of the invention, large-format and desktop printers of the character previously described manufactured and sold by The Hewlett-Packard Company as Designjet, Models 1050C/1055CM, 1120C and 1220C have proven satisfactory. Another commercially available printhead that is usable in combination with the positioning means of the invention is a printhead manufactured and sold by Xaar, plc of Cambridge, United Kingdom. The modified printers used in the present application are microprocessor-based digital printers that receive plotting instructions from an associated host computer 129 (FIG. 18). It is also to be understood that either a printer or a plotter apparatus could be specifically designed for a given application and could be used with positioning means of the character presently to be described in performing the method of the invention. Such an apparatus would preferably incorporate a reciprocally movable cartridge assembly that could imprint images on a stationary object.

As best seen in FIG. 15, the positioning means of the apparatus of the present invention comprises an upstanding frame 130 that supports the modified printer 126 in the manner shown in FIG. 15. In the present form of the invention modified printer 126 comprises a housing 132 which houses the printer carriage 128*a*, which carries the print heads heads 128, and a control unit 134 (FIGS. 19B and 22), which includes the control circuitry of the apparatus. Computer 129 (FIG. 18) functions to communicate to the control circuitry and to the printer the predetermined image or graphic that is to be imprinted on the selected three-dimensional article to be imprinted. As before, the image or graphic can be scanned or can be originally generated in the computer environment with specialized software. Typically, the computer image or graphic is stored on a hard drive and sent via a cable 135 to the control circuitry of the printer. Techniques for scanning or originally generating the image or indicia to be imprinted on the three-dimensional article are well known to those skilled in the art.

Data transfer is controlled by the computer 129, which generates and transmits to the printer via the control circuitry the necessary timing signals to properly sequence the processing of data and instructions to the printer. The printer memory typically contains the operating system to control printer operation using the control panel. The ink jet print heads 128, which upon command, travel longitudinally of the print zone of the printer along the print head carriage 128*a*, are preferably of very high resolution, such as those previously described herein.

The ink, which is dispensed by the ink jet print heads, can be either solvent or waterbased and is carried by the cartridges in a manner generally disclosed in previously identified U.S. Pat. Nos. 4,646,106 and 4,592,292. The carriage of the printers typically contains a printed circuit board, which controls the firing of the nozzles in the ink jet print heads. In the apparatus of this latest form of the invention, the motor is also controlled from the main printed circuit assembly by the microprocessor 129 via the control circuitry housed within control unit 134.

Considering now the important article positioning means of this latest form of the invention for strategically positioning the articles to be imprinted relative to the print heads 128 of the printing apparatus. This means here comprises a novel article positioning assembly, generally designated in the drawings by the numeral 140. As previously mentioned, positioning assembly 140 sequentially positions each of the plurality of articles to be imprinted (shown in the drawings as baseball bats) in a manner such that the longitudinal axis of the selected one of the plurality of three-dimensional articles to be imprinted is maintained within a plane that is substantially parallel to and spaced-apart from the plane of the printing heads 128 of the printing assembly.

As best seen in FIGS. 15, 16A and 16B, article positioning assembly 140 here comprises the previously identified upstanding supporting frame 130 the upper portion 130*a* of which supports housing 132 of the printing assembly in the manner illustrated in FIG. 15. Supporting frame 130 includes first and second spaced apart sides 144 and 146 that are interconnected proximate their lower extremities by a base member 148. Rotatably carried by bearing assemblies 143, which are carried by sides 144 and 146, is a central axle 150 to which first and second spaced apart supporting wheels 152 and 154 are interconnected at spaced apart locations (FIGS. 19A and 19B).

Connected to side 144 of frame 140 is wheel rotation means for controllably rotating axle 150 along with and first and second supporting wheels 152 and 154. As best seen in FIG. 19A, this wheel rotation means here comprises pinion gear 156 that is affixed to the splined end 150*a* of the axle 150 and a rack member 158 which is driven by wheel driving motor means, shown here as an electric motor 160. A housing 162, which is affixed to side frame member 144, functions to enclose the pinion gear, the rack member and the electric motor 160.

Affixed to wheel 152 are thirteen circumferentially spaced apart first gripping means for releasably gripping the first or handle end of each of the plurality of three-dimensional articles which, here are shown as baseball bats, are to be imprinted (FIG. 17). Each of the first gripping means here comprises an axle 162 and a bat handle-engaging or gripping cup 164 that is interconnected with axle 162. As best seen by referring to FIG. 19A, each axle 162 is rotatably mounted within a bearing assembly 166 that is carried by wheel 152. In a manner presently to be described, the bat handle engaging cup 164 of each of the first gripping means is movable, against the urging of a first biasing means, here provided as a coil spring 167 which circumscribes axle 162, from a first position spaced apart from first supporting wheel 152 (see the central portion of FIG. 19A) to a second position proximate said first supporting wheel 152 (see the upper portion of FIG. 19A).

Also affixed to wheel 154 are thirteen circumferentially spaced apart second gripping means for gripping the second or barrel end of the plurality of three-dimensional articles "A". Each of these second gripping means here comprises a driven shaft 168 and a generally cup shaped, bat barrel engaging or gripping member 170 which is connected to the driven shaft for rotation there with. As indicated FIG. 19B, each of the driven shafts 168 is rotatably supported by a bearing assembly 172 which is carried by wheel 154. For a reason presently to be described, driven shaft 168 is provided with a tapered socket 174.

Also comprising a part of the article positioning means of the invention is a specially designed article rotating means which is connected to the supporting frame for controllably rotating a selected one of the plurality of second gripping means. As best seen by referring to FIG. 19B, this novel article rotating means here comprises a drive shaft 176, drive shaft motor means for rotating the drive shaft and interconnection means for interconnecting the drive shaft with driven shaft 168. The interconnection means here comprises a solenoid assembly 180 of conventional construction which is carried by frame side member 146. Solenoid assembly 180 is operably associated with drive shaft 176 for controllably moving the drive shaft forwardly in the manner shown in FIGS. 22 and 23 into an extended position against the urging of a second or drive shaft biasing means. More particularly, during the operation of the apparatus drive shaft 176 is moved by solenoid 180 from the first retracted position shown in FIG. 19B to the second extended position shown in FIGS. 22 and 23 wherein the tapered end portion 176*a* of shaft 176 is closely, drivably received within tapered socket 174 of shaft 168. In the present form of the invention, this drive shaft biasing means comprises a coil spring 181 which is disposed between an enlarged diameter portion 176*c* of drive shaft 176 and an inner housing 132*a* that houses solenoid assembly 180.

With the construction described in the preceding paragraph, when the drive shaft is moved into the second position shown in FIG. 22 and when the motor means, shown here as electric motor 182, is energized, axle 168, along with cup 170 and the baseball bat that is supported between cups 164 and 170 will be controllably rotated. In this regard, as best seen in FIGS. 16B, 18 and 19B, motor 182 has a drive shaft 182*a* which drives a gear 184 that is, in turn, affixed to a shaft 186. Shaft 186, which is rotatably supported by a pair of bearings 187, is provided with a splined end 186*a* that is slidably received within a ribbed bore 176*b* provided in shaft 176 (FIGS. 19B). When the solenoid is deenergized, spring 181 will cause the shaft 176 to return to its normal retracted position shown in FIG. 19B. A portion of the previously identified housing 132, which is affixed to side frame member 146, functions to enclose motor 182 as well as the interconnection means of the invention.

In accomplishing the method of the invention, the article positioning means is first loaded with the articles to be imprinted, in this case a plurality of baseball bats. This is done by sequentially inserting the handle portion of each bat into a selected one of the handle gripping cups 164 and exerting a rearward pressure, that is to the left as viewed in FIG. 15. This rearward pressure causes spring 167 to compress so as to provide sufficient clearance to permit the barrel end of each of the bats to be inserted into the barrel engaging or gripping cups 170. With the positioning means fully or partially loaded, one of the bats, such as the bat designated as "A-1" in FIG. 15, includes a curved surface that resides immediately below the print heads 128*a* of the printing carriage. With the bat in this position, the solenoid 180 will be energized by the computer-controlled, control unit 134 in a manner to urge the shaft 176 to the left so as to force the tapered end portion 176*a* thereof into driving engagement with the socket 174 provided in shaft 168 (see FIGS. 22 and 23). The control unit 134 will next energize motor 182 so as to impart rotation to shaft 182*a*, to shaft 186, to shaft 176 and to barrel gripping cup 170. Rotation of cup 170, which is in frictional engagement with the barrel end of the bat, will cause the bat to rotate about its longitudinal axis "L" (FIG. 15) at uniform, predetermined rate. In this regard, and by way of non-limiting example, when the image to be printed comprises, a depiction of a human figure, such as a baseball player of the character shown in FIG. 22, the desired image is either scanned or originally computer generated using specialized software of a character well known to those skilled in the art. As discussed in connection with the earlier described embodiment of the invention, because of the tapered configuration of the bat, it is necessary to produce a distorted image that is of a character, which generally conforms to the planar projection of the surface to be imprinted, the image being substantially narrowed so as to conform to the tapering of the bat (see FIG. 14). When this distorted image is printed by the printer in accordance with appropriate instructions given by to the control circuitry of the printer by host computer 129, the image will be neatly wrapped around the curved barrel surface as well as the tapered and handle portions of the bat to produce a desired nonoverlapping result. As previously discussed herein, image distortion of the character described can be easily accomplished by those skilled in the art using several types of readily commercially available morphing type software, to create a file that is readable by the control circuitry of the modified microprocessor based printer being used.

The nature and extent of the distortion of the image to be imprinted is, of course, dependent on the configuration of the article to be imprinted. When the article has the configuration of a baseball bat, the bat must first be dimensionally analyzed to determine the character of the surface of the bat that is to be imprinted. Such an analysis can readily be accomplished by those skilled in the art and typically involves a determination of the diameter of the barrel portion of the bat and the degree of reduction in diameter or extent of taper of the tapered and handle portion upon which the image is to appear. Such a dimensional analysis of a baseball bat is relatively simple and need not be particularly precise so long as the surface to be imprinted can be projected into a planar configuration. Once the distorted image is created and appropriately loaded into the printer and the bat is rotated in the manner previously described, the ink cartridges will move through the print zone in the conventional manner previously discussed and will appropriately deposit ink onto the surface of the bat to create the desired appropriately distorted image (see FIG. 22). More particularly, as the bat rotates, the control circuitry of the printer responding to the instructions received from the preprogrammed host computer 129 will direct the ink jet heads to controllably deposit ink onto the surface of the bat in accordance with the predetermined software that has been developed to produce the desired image on the baseball bat.

When the printing of the uppermost bat "A-1" is completed, solenoid 180 is deenergized so as to permit spring 182 to urge shaft 176 to return to its retracted position as shown in FIG. 19B. Following retraction of the shaft 176, motor 160 can be energized by the control circuitry of the apparatus to cause controlled rotation of central shaft 150 and the concomitant rotation of wheels 152 and 154 to a position wherein the next in order article to be imprinted, such is the article designated as "A-2" in FIG. 15, is moved into position below the printing heads 128*a*. With the bat "A-2" in this position, the solenoid 80 will once again be energized by the computer-controlled, control unit 134 in a manner to urge the shaft 176 to the left so as to force the tapered end portion 176*a* thereof into driving engagement with the socket 174 provided in shaft 168. The control unit 134 will next energize motor 182 so as to impart rotation to shaft 176, to shaft 168 and to cup 170. Rotation of cup 170, which is in frictional engagement with the bat "A-2", will cause the bat to rotate about its longitudinal axis "L" at uniform, predetermined rate so that the printing operation can be accomplished in the manner described in the preceding paragraphs.

Following the completion of the printing of the bat"A-2", the remaining unprinted bats mounted within the positioning means can be imprinted in the same manner as discussed in the preceding paragraphs. When all of the bats mounted within the positioning means have been imprinted with the selected indicia, the bats can be removed from the positioning means by sequentially exerting a rearward pressure on holding cups 164 in a manner to compress springs 167 sufficiently to provide the clearance necessary to permit the removal of the opposite end of the bats from the cups 170.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. A printing apparatus for printing indicia on a plurality of three-dimensional articles each having a first end, a second end, a longitudinal axis and a curved surface upon which the indicia is to be imprinted, the apparatus comprising:

(a) a supporting frame;

(b) a modified microprocessor-based printer assembly connected to said supporting frame for printing indicia based on printing instructions received from a microprocessor, said printer assembly including a carriage which carries at least one ink jet cartridge for movement with said supporting frame and means for controlling firing of the nozzle of the ink jet cartridge; and (c) positioning means connected to said supporting frame for positioning a selected one of the plurality of three-dimensional articles relative to said printing assembly in a manner such that the longitudinal axis of the selected one of the plurality of three-dimensional articles is maintained within a plane that is substantially parallel to and spaced-apart from said carriage of said printing assembly, said positioning means comprising an article positioning assembly comprising:

(i) first and second spaced apart supporting wheels rotatably carried by said support frame;

(ii) wheel rotation means for controllably rotating said first and second spaced apart supporting wheels;

(iii) a plurality of circumferentially spaced apart first gripping means connected to said first supporting wheel for gripping the first end of a selected one of the plurality of three-dimensional articles, each of said plurality of spaced apart first gripping means comprising a first, generally cup shaped member that is movable from a first position spaced apart from said first supporting wheel to a second position proximate said first supporting wheel;

(iv) a plurality of circumferentially spaced apart second gripping means for gripping the second end of a selected one of the plurality of the three-dimensional articles; and (v) article rotating means connected to said supporting frame for controllably rotating a selected one of said plurality of second gripping means.

2. The printing apparatus as defined in claim 1 in which said second gripping means includes a driven shaft and a second generally cup shaped member connected to said driven shaft for rotation there with, said shaft being rotatably supported by said second wheel.

3. The printing apparatus as defined in claim 2 in which said article rotating means comprises: and (a) a drive shaft;

(b) motor means for rotating said drive shaft;

(c) interconnection means for interconnecting said drive shaft with said driven shaft for imparting rotation thereto upon rotation of said drive shaft by said motor means.

4. The printing apparatus as defined in claim 2 in which said supporting frame comprises first and second spaced apart sides and in which said wheel rotating means comprises an axle rotatably supported by said first and second sides, said first and second wheels being connected to said axle for rotation there with.

5. The printing apparatus as defined in claim 4 in which said wheel rotating means further comprises means for controllably rotating said axle.

6. The printing apparatus as defined in claim 5 in which said first gripping means includes a shaft, said first generally cup shaped member being connected to said shaft for rotation there with, said shaft being rotatably supported by said first wheel.

7. The printing apparatus as defined in claim 6, further including biasing means for yieldably resisting movement of said first generally cup shaped member of said first gripping means from a first position spaced apart from said first supporting wheel to a second position proximate said first supporting wheel.

8. The printing apparatus as defined in claim 7 in which said biasing means comprises a coil spring circumscribing said shaft of said first gripping means.

9. In combination with a modified microprocessor-based printer that produces copies of computer data based on printing instructions received from a host computer, said printer being of a character having a carriage which carries at least one ink jet cartridge for movement along the length of the print zone of the printer within a first plane and means for controlling firing of the nozzle of the ink jet cartridge, the improvement comprising positioning means for positioning a plurality of three-dimensional articles, each having first and second ends and a longitudinal axis, relative to the printer in a manner such that the longitudinal axis of the article is at all times during the printing operation maintained within a second plane that is parallel to and spaced-apart from the first plane, said positioning means comprising an article positioning assembly comprising:

(a) a supporting frame having first and second spaced apart sides;

(b) an axle rotatably supported by said first and second sides;

(c) first and second supporting wheels connected to said axle at spaced apart locations;

(d) wheel rotation means connected to said frame for controllably rotating said axle and said first and second spaced apart supporting wheels;

(e) a plurality of circumferentially spaced apart first gripping means connected to said first supporting wheel for gripping the first end of a selected one of the plurality of three-dimensional articles, each of said plurality of spaced apart first gripping means comprising a first generally cup shaped member that is movable from a first position spaced apart from said first supporting wheel to a second position proximate said first supporting wheel;

(f) a plurality of circumferentially spaced apart second gripping means rotatably connected to said second wheel for gripping the second end of a selected one of the plurality of the three-dimensional articles, each of said second gripping means comprising a driven shaft and a generally cup shaped member connected to said driven shaft for rotation there with;

(g) article rotating means connected to said supporting frame for controllably rotating a selected one of said driven shafts of said plurality of second gripping means, said article rotating means comprising:

(i) a drive shaft movable between a first retracted position and a second extended position;

(ii) motor means for rotating said drive shaft; and (iii) interconnection means for interconnecting said drive shaft with said driven shaft for imparting rotation thereto upon rotation of said drive shaft by said motor means.

10. The combination as defined in claim 9 in which said interconnection means comprises a solenoid assembly carried by said frame and operably associated with said drive shaft for moving said drive shaft between said first and second positions.

11. The combination as defined in claim 10 in which said driven shaft is provided with a tapered socket and in which said drive shaft is provided with a tapered end receivable within in said tapered socket.

12. A method for imprinting an image on a portion of the surface of a baseball bat by using a modified microprocessor-based printer that includes control circuitry that functions to cause the printer to produce a copy of computer data based on printing instructions received from a host computer, the printer being of a character having a carriage which carries at least one ink jet cartridge having a nozzle for movement along the length of the print zone of the printer within a first plane and means for controlling the firing of the nozzle of the ink jet cartridge, the modified microprocessor based printer comprising an article positioning assembly for holding a plurality of circumferentially spaced apart bats in a manner such that the bats can be sequentially moved into a position proximate the nozzle of the ink jet cartridge, said method comprising the steps of:

(a) analyzing the baseball bat to determine the configuration of the portion of the surface of the baseball bat that is to be imprinted;

(b) positioning a plurality of baseball bats within the article positioning assembly;

(c) rotating said article positioning assembly to bring a selected one of said plurality of baseball bats into proximity with the nozzle of the ink jet cartridge;

(d) rotating said selected one of the baseball bats about its longitudinal axis;

(e) producing a non-distorted image;

(f) distorting said non-distorted image in a manner to produce a distorted image that generally corresponds with the surface of the baseball bat that is to be imprinted;

(g) using the host computer, transmitting the printer instructions to the printer instructing the printer to fire the nozzle of the ink jet cartridge in a manner to print said distorted image on the rotating baseball bat.

13. The method as defined in claim 12 in which the modified printer carries a plurality of ink jet cartridges each having a nozzle and in which the printer is instructed by the host computer to fire the nozzles of the plurality of ink jet cartridges to produce the distorted image on the rotating baseball bat.

14. The method as defined in claim 13 in which the image depicts a human figure.

* * * * *